US011142431B2

(12) United States Patent
Li et al.

(10) Patent No.: US 11,142,431 B2
(45) Date of Patent: Oct. 12, 2021

(54) STABILIZING DEVICE OF ELEVATOR CAR AND A CONTROL METHOD THEREOF, AN ELEVATOR SYSTEM

(71) Applicant: Otis Elevator Company, Farmington, CT (US)

(72) Inventors: Qing Li, Tianjin (CN); Kai Kang, Tianjin (CN); ShengYu Wang, Tianjin (CN); Xiaokai Gong, Tianjin (CN); XiaoBin Tang, Tianjin (CN); ZhengZong Tang, Tianjin (CN); Wenbo Liu, Tianjin (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 819 days.

(21) Appl. No.: 15/866,847

(22) Filed: Jan. 10, 2018

(65) Prior Publication Data

US 2018/0194595 A1 Jul. 12, 2018

(30) Foreign Application Priority Data

Jan. 10, 2017 (CN) ..... 201710015473.2

(51) Int. Cl.
*B66B 11/02* (2006.01)
*B66B 5/18* (2006.01)
(Continued)

(52) U.S. Cl.
CPC ..... *B66B 11/0293* (2013.01); *B66B 1/32* (2013.01); *B66B 5/18* (2013.01); *B66B 7/042* (2013.01)

(58) Field of Classification Search
CPC ..... B66B 11/0293; B66B 7/042; B66B 5/18; B66B 1/32; B66B 7/10; B66B 11/026
See application file for complete search history.

(56) References Cited

U.S. PATENT DOCUMENTS 4,750,590 A 6/1988 Otala
5,086,882 A 2/1992 Sugahara et al.
(Continued)

FOREIGN PATENT DOCUMENTS

CN 205011197 U 2/2016
JP H0952679 A 2/1997
(Continued)

OTHER PUBLICATIONS

European Search Report for application EP 18150939.9, dated Aug. 20, 2018, 8 pages.

*Primary Examiner* — Jeffrey Donels
(74) *Attorney, Agent, or Firm* — Cantor Colburn LLP

(57) ABSTRACT

The present invention provides a damper of an elevator car, a control method of the damper, and an elevator system, belonging to the technical field of elevators. The damper of the present invention includes a base, a clamping mechanism mainly including two clamp arm components, a solenoid drive part, and a link transmission component, wherein the link transmission component is configured to be movable in a direction approximately perpendicular to a guide surface and drive at least one of the two clamp arm components connected thereto to move towards a guide rail. The control method of the present invention can enable the damper to work in a disengaged state, a slight contact state or a damping output state.

19 Claims, 14 Drawing Sheets

(51) Int. Cl.
*B66B 1/32* (2006.01)
*B66B 7/04* (2006.01)

(56) References Cited

U.S. PATENT DOCUMENTS

| | | | | |
|---|---|---|---|---|
| 5,360,085 | A | 11/1994 | Yoo et al. | |
| 5,896,949 | A | 4/1999 | Hamdy et al. | |
| 7,314,119 | B2 | 1/2008 | Husmann et al. | |
| 7,401,683 | B2 | 7/2008 | Husmann et al. | |
| 8,746,411 | B2 | 6/2014 | Roberts et al. | |
| 9,321,610 | B2 | 4/2016 | Fargo et al. | |
| 9,457,988 | B1 * | 10/2016 | Anderson | F16H 25/2003 |
| 9,856,111 | B1 * | 1/2018 | Anderson | B66B 5/16 |
| 2009/0032340 | A1 | 2/2009 | Smith | |
| 2014/0339025 | A1 | 11/2014 | Kocher | |
| 2015/0151949 | A1 | 6/2015 | Kocher et al. | |
| 2015/0291396 | A1 | 10/2015 | Nakamura et al. | |
| 2015/0321880 | A1 | 11/2015 | Schonauer | |
| 2016/0214833 | A1 | 7/2016 | Kattainen et al. | |
| 2017/0036888 | A1 * | 2/2017 | Ladner | B66B 5/18 |
| 2018/0044136 | A1 * | 2/2018 | Kakio | B66B 5/22 |
| 2018/0127238 | A1 * | 5/2018 | Guo | H01H 3/16 |
| 2018/0237265 | A1 * | 8/2018 | Fargo | B66B 7/068 |
| 2019/0276276 | A1 * | 9/2019 | Husmann | B66B 5/24 |

FOREIGN PATENT DOCUMENTS

| | | | |
|---|---|---|---|
| JP | 2014162575 | A | 9/2014 |
| WO | 2011021064 | A1 | 2/2011 |
| WO | 2016096764 | A1 | 6/2016 |

* cited by examiner

STABILIZING DEVICE OF ELEVATOR CAR AND A CONTROL METHOD THEREOF, AN ELEVATOR SYSTEM

TECHNICAL FIELD

The present invention belongs to the technical field of elevators, and relates to a damper of an elevator car, an elevator system using the damper, and a control method of the damper.

BACKGROUND ART

An elevator car of an elevator system is dragged or suspended by using a dragging medium such as a steel rope or a steel belt. Especially, when stopping at a particular floor to load/unload passengers or goods, the elevator car is suspended by the steel rope or steel belt and stops in a hoistway to facilitate loading or unloading.

However, the dragging medium such as the steel rope or steel belt is more or less elastic. If the weight of the elevator car significantly changes during loading or unloading, the elevator car may vibrate vertically along a guide rail direction, especially when the steel rope or steel belt is relatively long. Such vibration causes the elevator car to be unstable when it stops at a particular floor and leads to poor passenger experience.

SUMMARY OF THE INVENTION

The present invention at least provides the following technical solutions to solve the foregoing problems.

According to a first aspect of the present invention, a damper (100) of an elevator car (13) is provided, including: a base (110) fixedly mounted with respect to the elevator car (13); a clamping mechanism used for clamping a guide surface of a guide rail (11) to generate a friction ($F_{riction}$) for preventing the elevator car (13) from moving, the clamping mechanism mainly including two clamp arm components (170*a*, 170*b*); a solenoid drive part (120) at least used for providing the clamp arm components (170*a*, 170*b*) with a force for clamping the guide surface (110) of the guide rail (11); and a link transmission component disposed between the solenoid drive part (120) and the clamping mechanism, where the link transmission component is configured to be movable in a direction approximately perpendicular to the guide surface (110) and drive at least one of the two clamp arm components (170*a*, 170*b*) connected thereto to move towards the guide rail (11).

According to a second aspect of the present invention, an elevator system (10, 20) is provided, including an elevator car (13) and a guide rail (11), and further including the foregoing damper (100).

According to a third aspect of the present invention, a control method of a damper (100) of an elevator car (13) is provided, the damper (100) being able to work in a disengaged state (31) and a damping output state (34) in which a friction ($F_{friction}$) for preventing the elevator car (13) from moving is generated, wherein in the control method, the damper (100) is enabled to transit from the disengaged state (31) to a slight contact state (33) and then transit from the slight contact state (33) to the damping output state (34), where the slight contact state (33) means that the damper (100) contacts a guide rail (11) but basically does not generate any pressure on the guide rail (11) or generates a pressure on the guide rail (11) but hardly affects normal operation of the elevator car (13).

According to a fourth aspect of the present invention, a control method of a damper (100) of an elevator car (13) is provided, the damper (100) being able to work in a disengaged state (31) and a damping output state (34) in which a friction ($F_{friction}$) for preventing the elevator car (13) from moving is generated, wherein: in the control method, the damper (100) is enabled to gradually transit from the damping output state (34) to a slight contact state (33), where the slight contact state (33) means that the damper (100) contacts a guide rail (11) but basically does not generate any pressure on the guide rail (11) or generates a pressure on the guide rail (11) but hardly affects normal operation of the elevator car (13).

According to a fifth aspect of the present invention, a controller (80, 90) of a damper (100) is provided, where the controller (80, 90) is configured to enable the damper (100) to work in a disengaged state (31), a slight contact state (33) or a damping output state (34) in which a friction ($F_{friction}$) for preventing the elevator car (13) from moving is generated; and the controller (80, 90) is further configured to: enable the damper (100) to transit from the disengaged state (31) to the slight contact state (33) and then transit from the slight contact state (33) to the damping output state (34), or enable the damper (100) to gradually transit from the damping output state (34) to the slight contact state (33), where the slight contact state (33) means that the damper (100) contacts a guide rail (11) but basically does not generate any pressure on the guide rail (11) or generates a pressure on the guide rail (11) but hardly affects normal operation of the elevator car (13).

According to a sixth aspect of the present invention, an elevator system (10, 20) is provided, including an elevator car (13), a guide rail (11) and a damper, and further including the foregoing controller (80, 90) used for controlling the damper.

The foregoing features and operations of the present invention will become more evident according to the following description and accompanying drawings.

BRIEF DESCRIPTION OF THE DRAWINGS

In the following detailed description with reference to the accompanying drawings, the foregoing and other objectives and advantages of the present invention will become more complete and clearer, where identical or similar elements are represented by using identical reference numerals.

DETAILED DESCRIPTION

The present invention is now described more thoroughly with reference to the accompanying drawings. The drawings show exemplary embodiments of the present invention. However, the present invention may be implemented according to a lot of different forms, and should not be construed as being limited by the embodiments illustrated herein. On the contrary, these embodiments are provided to make the present disclosure thorough and complete, and fully convey the idea of the present invention to those skilled in the art.

In the following description, to make the description clear and concise, not all parts shown in the figures are described in detail. Multiple parts that can fully implement the present invention are shown in the accompanying drawings for those of ordinary skill in the art. For those skilled in the art, operations of many parts are familiar and apparent.

In the following description, for ease of description, a direction of a guide rail in an elevator system is defined as a z-direction, a direction perpendicular to a guide surface of the guide rail is defined as a y-direction, and a direction perpendicular to the z-direction and the y-direction is defined as an x-direction. It should be understood that the definitions of these directions are used for relative description and clarification, and may change correspondingly according to changes in the orientation of the damper.

Figure 6:
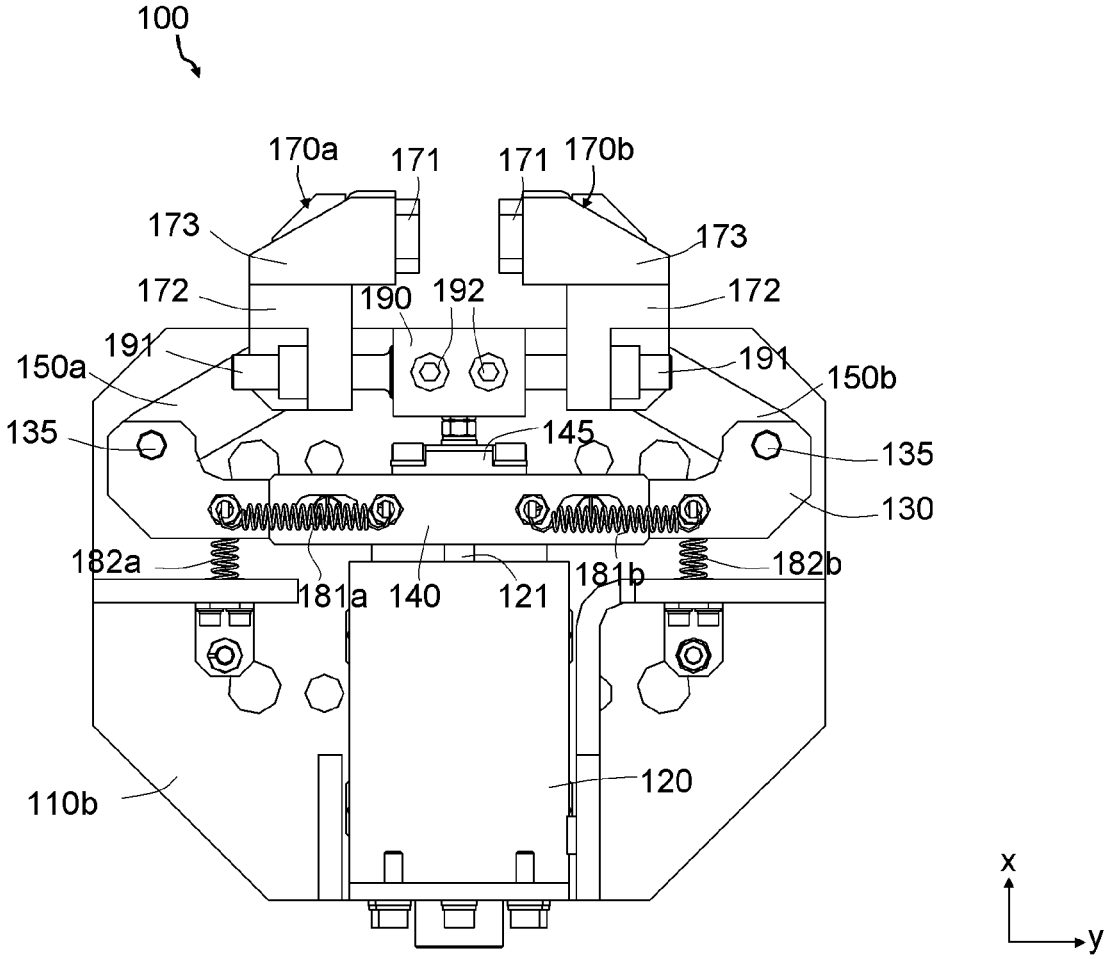
FIG. 6 is a top view of an internal structure of a damper in an embodiment shown in FIG. 3.
Figure 7:
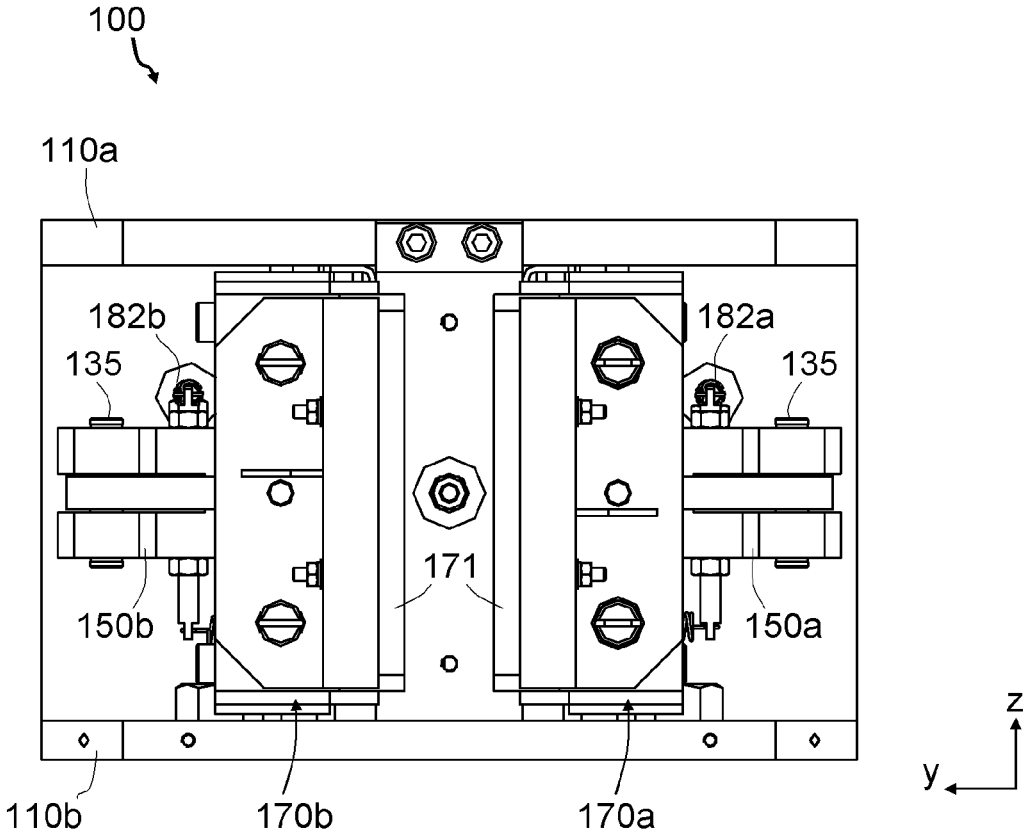
FIG. 7 is a right view of the damper in the embodiment shown in FIG. 2.
Figure 8:
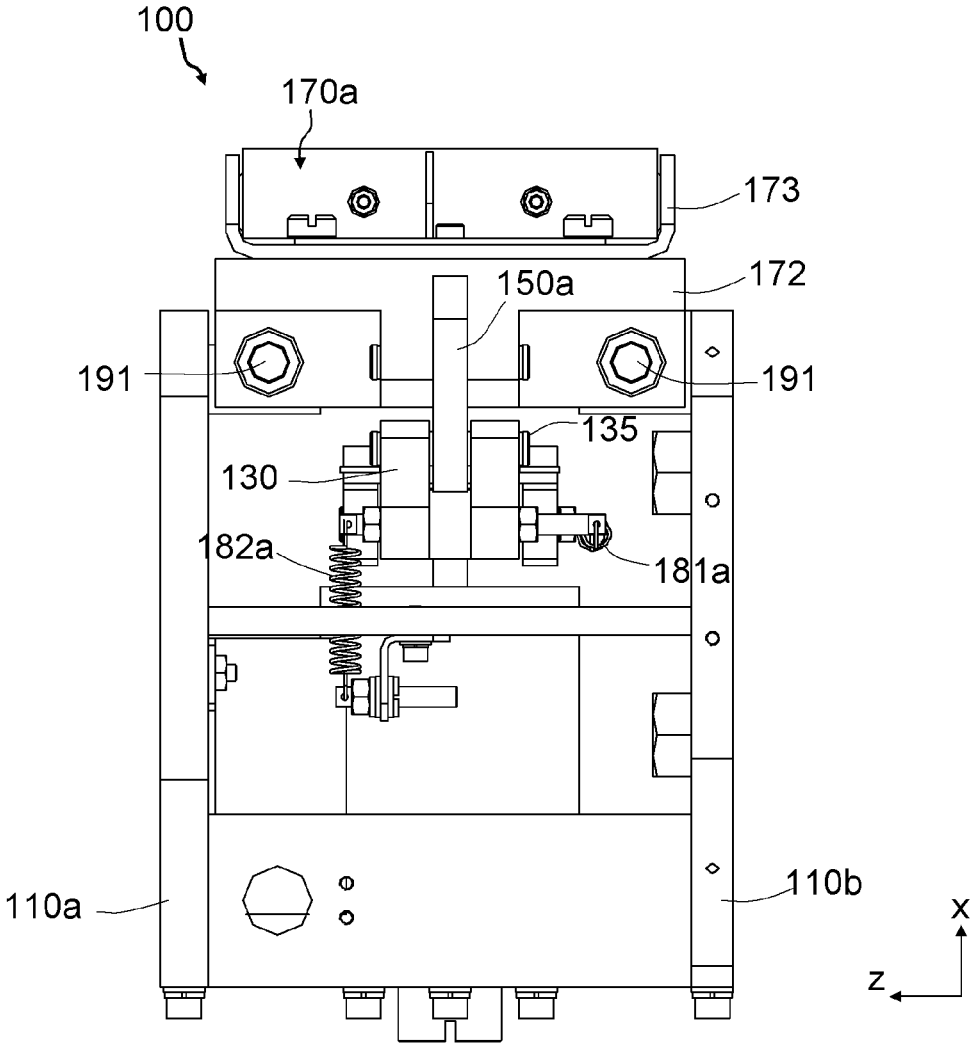
FIG. 8 is a front view of the damper in the embodiment shown in FIG. 2.

In the following description, unless otherwise specified, the orientation terms "upper" and "lower" are defined based on the x-direction (referring to FIG. 6), and the direction terms "left" and "right" are defined based on the y-direction (referring to FIG. 6). Moreover, it should be understood that these direction terms are relative concepts, which are used for relative description and clarification, and may change correspondingly according to changes in the mounting orientation of the damper.

A damper 100 of an elevator car according to an embodiment of the present invention and an elevator system 10 using the damper 100 are illustrated in detail below by using examples with reference to FIG. 1 to FIG. 12.

In the elevator system 10 in an embodiment, the elevator car 13 is dragged by using a dragging medium (such as a steel belt 14). During loading/unloading of the elevator car 13 (for example, when passengers get on or off), a change in the weight of the elevator car 13 may cause the steel belt 14 to have a certain degree of elastic deformation. As the elastic deformation of the steel belt 14 is relatively large, obvious vibration in the z-direction may occur.

Figure 1:
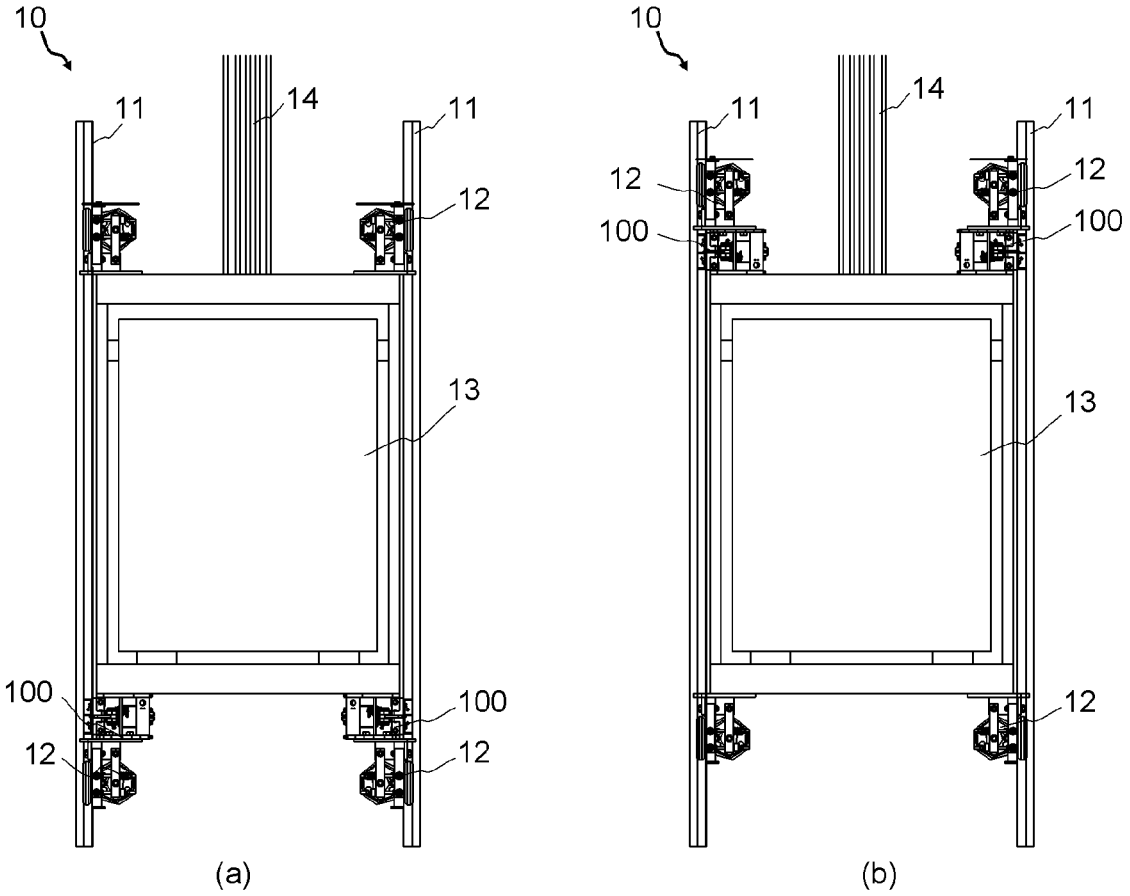
FIG. 1 is a side view of an elevator system according to an embodiment of the present invention, the elevator system using a damper 100 in an embodiment shown in FIG. 2, where FIG. 1(*a*) shows that the damper is mounted between a car body of an elevator car and a lower guide shoe, and FIG. 1(*b*) shows that the damper is mounted between a car body of an elevator car and an upper guide shoe.

The damper 100 is mounted on the elevator car 13. Specifically, as shown in FIG. 1, the damper 100 is mounted between a car body (such as a car frame) of the elevator car 13 and a guide shoe 12. For example, as shown in FIG. 1(*a*), the damper 100 is mounted at the bottom of the elevator car 13, and may be mounted between a lower guide shoe and the car body. For another example, as shown in FIG. 1(*b*), the damper 100 is mounted at the top of the elevator car 13, and may be mounted between an upper guide shoe and the car body. In other embodiments, the dampers 100 may be mounted correspondingly on the upper guide shoe and the lower guide shoe simultaneously. Specifically, a mounting manner may be selected according to a principle of not affecting normal operation of the elevator car 13 in a hoistway. The dampers 100 may be correspondingly mounted on two guide rails 11 simultaneously. The specific number of mounted dampers 100 is not limited.

A main function of the damper 100 in the embodiment of the present invention is to reduce vibration of the elevator car 13 in the z-direction when the elevator car 13 stops at the landing of a certain floor (for example, when a landing door of the landing is opened), to improve ride experience for passengers. Specifically, the damper 100 acts on the guide surface 110 of the guide rail 11 by means of clamping, and the damper 100 generates a clamping force, so that a friction $F_{riction}$ of certain magnitude is generated between the guide rail 11 and the damper 100. The friction $F_{riction}$ stops or damps vibration of the elevator car 13 in the z-direction. It should be understood that, by controlling the magnitude of the clamping force generated by the damper 100 (i.e., magnitude of a pressure applied on the guide surface 110), the damper 100 of the present invention can control the magnitude of the friction $F_{riction}$.

As shown in FIG. 2 to FIG. 8, the damper 100 includes a base 110, and the base 110 is fixedly mounted with respect to the elevator car 13. In an embodiment, the base 110 includes a first cover plate 110*a* and a second cover plate 110*b* that are disposed substantially parallel to each other. The first cover plate 110*a* and the second cover plate 110*b* are disposed in an xy-plane, and are disposed face to face in the z-direction. With reference to FIG. 1, during mounting of the damper 100, the damper 100 is fixedly mounted on the elevator car 13 by using the first cover plate 110*a*/second cover plate 110*b*. The guide shoe 12 is fixedly mounted on the second cover plate 110*b*/first cover plate 110*a* of the damper 100. In this way, the damper 100 has a simple mounting structure, and impact on the guide shoe 12 is reduced as much as possible.

Between the first cover plate 110*a* and the second cover plate 110*b*, the base 110 may be provided with various structures for fixing or limiting internal components of the damper 100, for example, a clamp arm mounting base 190 for mounting a clamp arm component 170, where two ends of the clamp arm mounting base 190 are fixed on the first cover plate 110*a* and the second cover plate 110*b* through mounting pins 192.

Referring to FIG. 2 to FIG. 12 continuously, a solenoid drive part 120 is disposed in the damper 100. The solenoid drive part 120 can provide an output force $F_{solenoid}$ when being electrified or being powered on and excited. The output force $F_{solenoid}$ may at least provide the damper 100 with a force required for clamping the guide rail 11. The solenoid drive part 120 has advantages such as a high working response speed and being easy to control through an electrical signal. A specific type of the solenoid drive part 120 is not limited. For example, the solenoid drive part 120 may be implemented by a solenoid and so on. In order to control output of the force $F_{solenoid}$ of the solenoid drive part 120, a corresponding controller (not shown in the figures) may be disposed. The controller may also serve as at least a part of the damper 100. In the following description about FIG. 17 and FIG. 18, the controller will be illustrated in detail with examples.

Referring to FIG. 2 to FIG. 12 continuously, the damper 100 is mainly provided with a clamping mechanism and a link transmission component therein. When the damper 100 works, the clamping mechanism is used for clamping the guide surface 110 of the guide rail 11, so as to generate a friction $F_{friction}$ for preventing the elevator car 13 from moving in the z-direction. The clamping mechanism mainly consists of two clamp arm components 170*a* and 170*b*, where 170*a* represents a left clamp arm component, and 170*b* represents a right clamp arm component. The two clamp arm components have substantially the same structure and are symmetrically disposed along the y-direction. Both the clamp arm components 170*a* and 170*b* are capable of performing horizontal motion or movement in the y-direction, and a force required for the movement is provided through transfer via the link transmission component. In a process of clamping the guide rail, the link transmission component can provide forces simultaneously to push both the clamp arm components 170*a* and 170*b* to move towards the guide rail 11, so that the clamp arm components 170*a* and 170*b* approach and finally contact the guide surface 110.

Figure 10:
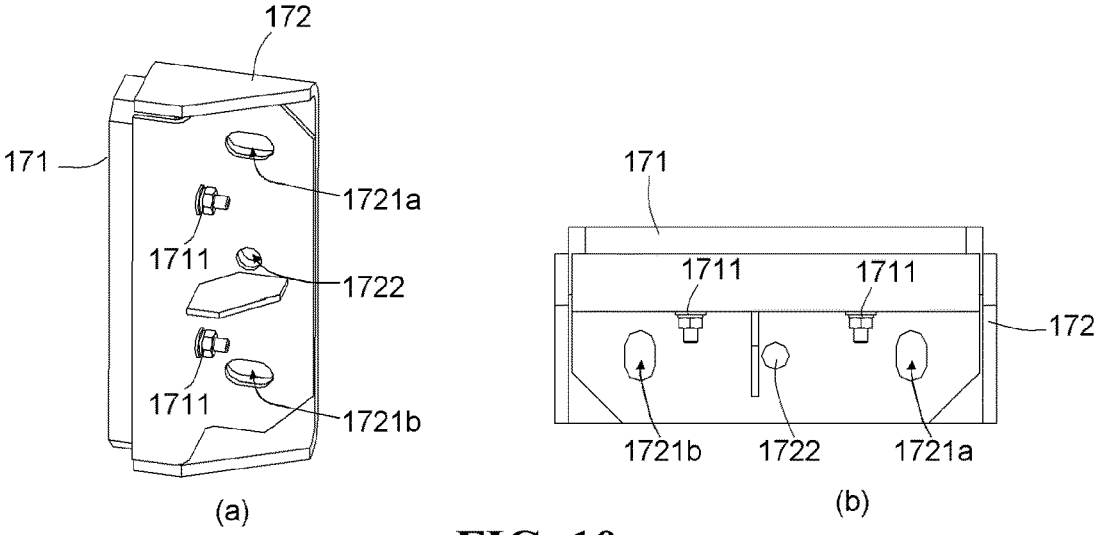
FIG. 10 is a schematic structural diagram of a friction plate and a friction plate mounting base of a clamp arm component of the damper in the embodiment shown in FIG. 2, where FIG. 10(*a*) is a three-dimensional schematic structural diagram, and FIG. 10(*b*) is a front view.

In an embodiment, as shown in FIG. 2 to FIG. 6, FIG. 8 and FIG. 10, each of the clamp arm components 170*a* and 170*b* includes a friction plate 171, a friction plate mounting base 173, and a clamp arm 172. The friction plate 171 is used for contacting the guide surface 110 of the guide rail 11 and generating a friction. The friction plate 171 is detachably mounted on the friction plate mounting base 173, and when the friction plate 171 needs to be replaced due to wear and tear or is maintained, it is convenient to detach and mount the friction plate 171. Therefore, the maintenance is easy and convenient. Specifically, the friction plate 171 may be detachably mounted on the friction plate mounting base 173 by using two or more screws 1711 (as shown in FIG. 10). The specific material type and shape design of the friction plate 171 are not limited.

Further, the friction plate mounting base 173 is mounted at a tail end of the clamp arm 172. The clamp arm 172 is mounted on the clamp arm mounting base 190 which is fixed on the base 110, and the clamp arm mounting base 190 is provided with a guiding shaft 191 along the y-direction. Each clamp arm 172 is mounted on the guiding shaft 191 and is capable of performing motion or movement on the guiding shaft 191. In this way, it is implemented that each clamp arm 172 is capable of performing horizontal movement or motion in the y-direction approximately. The clamp arm component 170*a* or 170*b* as a whole thus is capable of horizontal movement or motion in the y direction approximately.

In an embodiment, by means of configuration, it is implemented that the friction plate mounting base 173 is rotatable in a predetermined angle range with respect to the guide surface 110 (for example, rotating by a predetermined angle in the xy-plane), so that the friction plate 171 fixedly mounted on the friction plate mounting base 173 can adaptively generate a maximum contact surface with the guide rail 11. This helps the damper 100 generate a sufficient friction, so that the work becomes more stable and reliable. Especially in the case where the guide surface 110 is deformed due to deformation of the guide rail 11, in the process of clamping the guide rail 11, the friction plate 171 is able to adaptively adjust the angle thereof with respect to the guide surface 110.

Specifically, the foregoing function may be realized by setting a mounting manner of the friction plate mounting base 173. For example, as shown in FIG. 10, the friction plate mounting base 173 is provided with a mounting hole 1722 and two mounting holes 1721*a* and 1721*b*. Bolts are disposed in the mounting holes 1722, 1721*a* and 1721*b* respectively, so as to mount the friction plate mounting base 173 on the clamp arm 172. By shaping the mounting holes 1721*a* and 1721*b*, the whole friction plate mounting base 173 is rotatable in a predetermined angle range with respect to the bolt in the mounting hole 1722. For example, the mounting holes 1721*a* and 1721*b* are shaped to be elliptical, or may be shaped to be rectangular and so on. Therefore, the elliptical or rectangular mounting holes 1721*a* and 1721*b* provide rotation spatial redundancy for the rotation of the friction plate mounting base 173 with respect to the guide surface 110.

Referring to FIG. 2 to FIG. 12 continuously, the link transmission component of the damper 100 is disposed between the solenoid drive part 120 and the clamping mechanism, and can transfer the force $F_{solenoid}$ output by the solenoid drive part 120 to the two clamp arm components 170 of the clamping mechanism and convert vertical motion of the output shaft 121 of the solenoid drive part 120 into horizontal movement of the clamp arm component 170. In the process of clamping the guide rail 11, in order to implement an alignment operation adaptively, the link transmission component is configured to be movable in the y-direction and drive at least one of the clamp arm components 170*a* and 170*b* connected thereto to move towards the guide rail 11. Therefore, in an embodiment, a guiding part 140 for implementing y-direction movement of the link transmission component is disposed in the damper 100.

Figure 9:
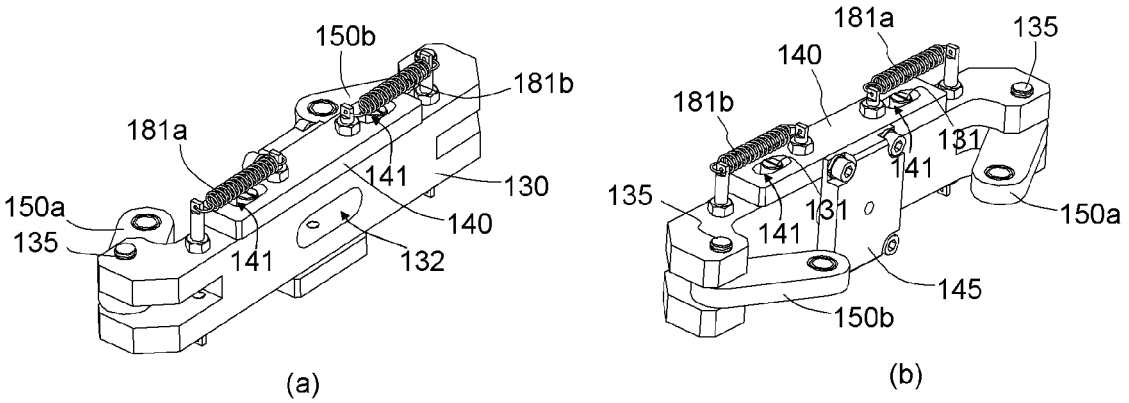
FIG. 9 is a schematic structural diagram of a link transmission component and a guiding part of the damper in the embodiment shown in FIG. 2, where FIG. 9(*a*) is a three-dimensional schematic structural diagram from one viewing angle, and FIG. 9(*b*) is a three-dimensional schematic structural diagram from another viewing angle.

A specific structure of the guiding part 140 is as shown in FIG. 9. The guiding part 140 is limited in the y-direction, to prevent the guiding part 140 from moving horizontally along with the link transmission component. Moreover, the guiding part 140 is capable of performing motion in the z-direction. For example, during upward motion, the output shaft 121 of the solenoid drive part 120 directly acts on the guiding part 140, to drive the guiding part 140 to move upward.

Correspondingly, the link transmission component mainly includes a push rod 130 and two connecting rods 150 (150*a* and 150*b*) that are disposed at two ends of the push rod 130 in a hinged manner. Two ends of the connecting rod 150*a* are rotatably connected to the left end of the push rod 130 (for example, the left end of the connected push rod 130 is connected to an end of the connecting rod 150*a* through a pivotal shaft 135) and the clamp arm 172 of the left clamp arm component 170*a* respectively, and two ends of the connecting rod 150*b* are rotatably connected to the right end of the push rod 130 (for example, the right end of the connected push rod 130 is connected to one end of the connecting rod 150*b* through a pivotal shaft 135) and the clamp arm 172 of the right clamp arm component 170*b*. The push rod 130 is disposed on the guiding part 140; both the push rod 130 and the guiding part 140 are disposed in the y-direction. The push rod 130 is substantially parallel to the guiding shaft 191 of the clamp arm mounting base 190. In this way, the push rod 130, the connecting rods 150*a* and 150*b*, and the guiding shaft 191 form a roughly trapezoid structure, where the push rod 130 forms the relatively long base of the trapezoid structure, and the connecting rods 150*a* and 150*b* form the lateral sides of the trapezoid structure.

Figure 11:
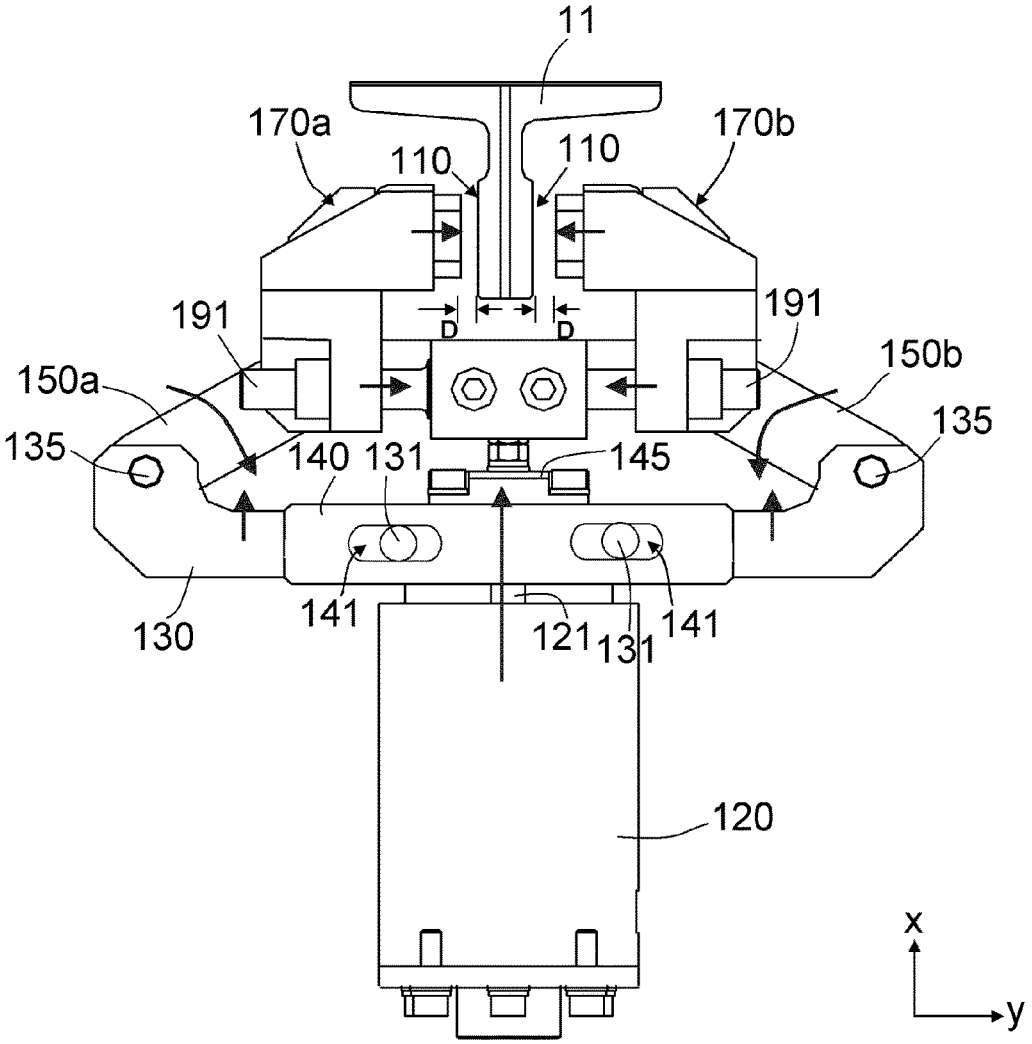
FIG. 11 is a schematic diagram of a basic working principle when the damper in the embodiment shown in FIG. 2 clamps a guide rail.

As shown in FIG. 11, when the force $F_{solenoid}$ output by the output shaft 121 of the solenoid drive part 120 drives the guiding part 140 to move upward, the push rod 130 of the guiding part 140 also moves upward. Pushed by the push rod 130, the connecting rod 150*a* rotates clockwise as shown in FIG. 11, and the connecting rod 150*b* rotates anticlockwise as shown in FIG. 11. Further, the connecting rod 150*a* pushes the whole left clamp arm component 170*a* to move towards the guide rail 11 along the guiding shaft 191, and the connecting rod 150*b* also pushes the whole right clamp arm component 170*b* to move towards the guide rail 11 along the guiding shaft 191. A distance D from the right clamp arm component 170*b* and the left clamp arm component 170*a* to the guide surface 110 of the guide rail 11 becomes smaller, till D=0, that is, the friction plate 171 contacts the guide surface 110. Moreover, the force $F_{solenoid}$ output by the solenoid drive part 120 may be converted continuously and act on the guide surface 110 through the friction plate 171, thereby generating a friction $F_{friction}$ of certain magnitude.

Therefore, the push rod 130 and the connecting rod 150 in the foregoing embodiment can convert the force $F_{solenoid}$ output by the output shaft 121 of the solenoid drive part 120 into a force that pushes the clamp arm component 170 to move towards the guide surface 110.

Figure 12:
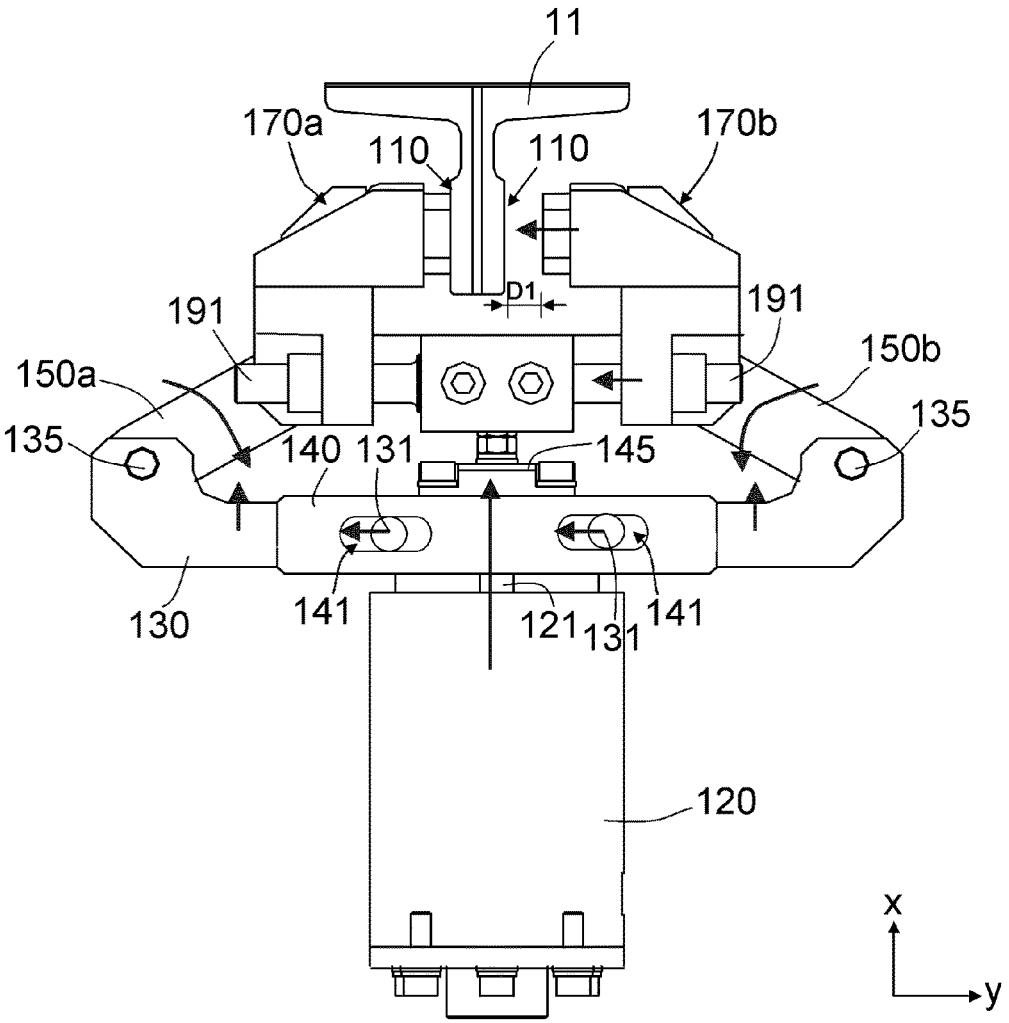
FIG. 12 is a schematic diagram of a basic working principle during an alignment process when the damper in the embodiment shown in FIG. 2 clamps a guide rail.

Referring to FIG. 9, FIG. 11, and FIG. 12 continuously, in an embodiment, the guiding part 140 is provided with several guiding holes 141, and the push rod 130 is correspondingly provided with a guiding protrusion 131. The guiding protrusion 131 is placed in the guiding hole 141 and is guided to move in the guiding hole 141 in a limited manner, so that the push rod 130 is capable of moving in the y-direction. Specifically, the guiding hole 141 is an elliptical hole opened in the y-direction, and the guiding protrusion 131 is provided with a rolling bearing, and therefore can freely roll horizontally by a predetermined distance in the elliptical hole along the y-direction. It should be noted that when the push rod 130 performs horizontal movement or motion in the y-direction, as the guiding part 140 is limited in the y-direction, it basically would not perform movement or motion in the y-direction.

The feature that the link transmission component is movable in the y-direction will support the two clamp arm components 170*a* and 170*b* of the damper 100 in the embodiment of the present invention to implement an automatic alignment operation when the two clamp arm components 170*a* and 170*b* clamp the guide rail 11. As shown in FIG. 12, in the process of clamping the guide rail 11, it is possible that one clamp arm component 170 contacts the guide surface 110 of the guide rail 11 first while the other clamp arm component 170 does not contact the guide surface 110. For example, the left clamp arm component 170*a* contacts the guide surface 110 of the guide rail 11 but the right clamp arm component 170*b* still has a distance D1 from the guide surface 110 of the guide rail 11. In this case, the solenoid drive part 120 continues to output the force $F_{solenoid}$, and the force $F_{solenoid}$ is at least partially converted by the link transmission component into a reactive force generated by the guide surface 110 against the left clamp arm component 170*a* in contact with the guide surface 110. The reactive force pushes the link transmission component (including the push rod 130) to move leftwards with respect to the guiding part 140 in the y-direction, and drives the right clamp arm component 170*b* to move towards the guide surface 110 of the guide rail 11, till the friction plate 171 of the right clamp arm component 170*b* also contacts the guide surface 110 (i.e., D1=0), thus completing the alignment operation. The alignment operation may be automatically completed in the process of clamping the guide rail, to avoid the problem that only one clamp arm component 170 acts on the guide surface of the guide rail 11 and thus the output friction cannot reach predetermined magnitude. The clamping is more effective, and it is ensured that the damper 100 works more reliably.

In an embodiment, as shown in FIG. 9, the push rod 130 is provided with a via hole 132 at a position corresponding to the output shaft 121 of the solenoid drive part 120. The output shaft 121 of the solenoid drive part 120 can freely pass through the via hole 132 to abut against the guiding part 140, for example, press against an upper cover plate 145 of the guiding part 140.

Referring to FIG. 2 to FIG. 9 continuously, first elastic restoration parts 181 are disposed between the guiding part 140 and the push rod 130. Specifically, the first restoration parts 181 may be, but are not limited to, elastic members such as springs. The first restoration parts 181 are disposed on two ends of the guiding part 140 respectively, and the first restoration parts 181*a* and 181*b* may be simultaneously arranged in the y-direction approximately. Two ends of each first restoration part 181 are fixed on the push rod 130 and the guiding part 140 respectively. In this way, when the push rod 130 moves in the y-direction, it is possible that one first restoration part 181 is compressed and the other first restoration part 181 is stretched. When the damper 100 finishes working, that is, when the force $F_{solenoid}$ output by the solenoid drive part 120 is nearly 0, a tensile force generated by the first restoration parts 181 during the alignment operation would drive the push rod 130 to be restored in position or to return on the guiding part 140, that is, the push rod 130 moves back to an initial position in the y-direction. It would be appreciated based on the foregoing working principle of the link transmission component that the link transmission component and the clamp arm components

170*a* and 170*b* would also be restored in the y-direction, for example, restored to positions where the friction plates 171 of the clamp arm components 170*a* and 170*b* each have a distance of approximately 6 mm to the guide surface 110 (i.e., corresponding to a disengaged state), thereby avoiding affecting normal passenger carrying motion of the elevator car 13.

Referring to FIG. 2 to FIG. 8 continuously, second elastic restoration parts 182 are further disposed between the push rod 130 and the base 110. Specifically, the second restoration parts 182 may be, but are not limited to, elastic members such as springs. The second restoration parts 182 are disposed on two ends of the push rod 130 respectively, and the second restoration parts 182*a* and 182*b* may be arranged in a substantially parallel manner in the x-direction approximately. Two ends of each second restoration part 182 are fixed on the push rod 130 and base 110 respectively. In this way, when the push rod 130 moves upward in the x-direction, the second restoration parts 182*a* and 182*b* are stretched. When the damper 100 finishes working, that is, when the force $F_{solenoid}$ output by the solenoid drive part 120 is nearly 0, a tensile force generated by the second restoration parts 182 during the clamping operation would drive the push rod 130 and the guiding part 140 to be restored in the vertical direction, i.e., the push rod 130 and the guiding part 140 move back to initial positions in the x-direction.

Setting of the foregoing first restoration parts 181 and second restoration parts 182 allows the link transmission component, the clamp arm components 170*a* and 170*b*, and the guiding part 140 to be able to automatically return to the initial positions in both the x-direction and y-direction, so as to prepare for the next operation of the damper 100, thus achieving good continuity of operation. Moreover, during normal passenger carrying motion of the elevator car 13, basically there would be no friction between the damper 100 and the guide rail 11, guaranteeing normal passenger carrying motion of the elevator car 13.

It should be noted that the damper 100 in the foregoing embodiment has a simple internal structure and is easy to assemble, and moreover, the internal parts such as the friction plate 171 are relatively easy to replace after wear and tear. Based on the working principle of the damper 100 in the foregoing embodiment as shown in FIG. 11 and FIG. 12, it would be understood that it is easy to accurately and effectively convert the force $F_{solenoid}$ output by the solenoid drive part 120 of the damper 100 into a relatively large force applied on the guide rail 11 by the two clamp arm components 170*a* and 170*b* (that is, a relatively large pressure applied on the guide rail 11), i.e., it is easy to accurately and effectively convert the force $F_{solenoid}$ into a damping friction $F_{friction}$ provided by the damper 100 to the car 13, and a relatively large damping friction $F_{friction}$ can be generated (even if the force $F_{friction}$ output by the solenoid drive part 120 is relatively small). Therefore, it is easy to implement, by means of the solenoid drive part 120, accurate control over the friction $F_{friction}$ output by the damper 100, and the power requirement on the solenoid drive part 120 is relatively low (the implementation does not rely on a high-power solenoid drive part 120).

After the elevator system 10 of the foregoing embodiment uses the damper 100, although the damper 100 can provide a sufficient friction (for example, dampers 100 on two guide rails 11 can provide a total friction $F_{friction}$ up to 700 N) to prevent the elevator car 13 from vibration, the working process of the damper 100 may cause at least the following problems: first, in a conventional control technology, guide rail clamping control on the damper employs a manner of directing transiting from a disengaged state to a damping output state (that is, a state in which a friction $F_{friction}$ for preventing the elevator car 13 from moving is generated, where in this case, the clamping mechanism of the damper tightly clamps the guide rail and generates a corresponding friction $F_{friction}$). This transition process is generally completed by powering on or electrifying the solenoid drive part instantaneously. Therefore, it is easy to produce relatively great impact, i.e., clamping impact, on the guide rail 11. This impact may generate extremely large noise, which reduces riding experience of the elevator car 13.

Secondly, during the clamping control on the damper in the foregoing conventional control technology, due to the relatively large friction $F_{friction}$ generated by the damper in the damping output state, it is very likely that the tension degree of the steel belt 14 does not reflect the actual tension degree or tensile status caused by the current weight of the elevator car 13, that is, the tension degree or tensile status of the steel belt 14 is easily affected by the friction $F_{friction}$. For example, when the solenoid drive part is powered on instantaneously to transit to the damping output state, the friction $F_{friction}$ generated by the damper may cause the steel belt 14 to be yanked in certain degree and generate vibration easily sensed by passengers, reducing passenger experience.

Thirdly, in the conventional control technology, releasing control on the damper employs a manner of directly transiting from the damping output state to the disengaged state, and this transition process is generally completed by powering off the solenoid drive part instantaneously. Therefore, the friction $F_{friction}$ released by the damper acts on the steel belt 14 instantaneously, which would cause the steel belt 14 to vibrate along the direction of the guide rail in certain degree. In the case where the friction generated by the damper in the damping output state is relatively large, passengers in the elevator car 13 can easily sense such vibration, and passenger experience is reduced.

Fourthly, although the friction generated by the damper prevents or alleviates vibration to stabilize the elevator car 13 when passengers or the like get on or get off the elevator car 13, the friction generated by the damper may also affect the accuracy of a weighing result of a car weighing operation process, especially when the weighing result is obtained based on a tension of the steel belt 13.

A control method and/or controller of the damper in the following embodiments of the present invention is at least one method for solving the foregoing problems.

Figure 13:
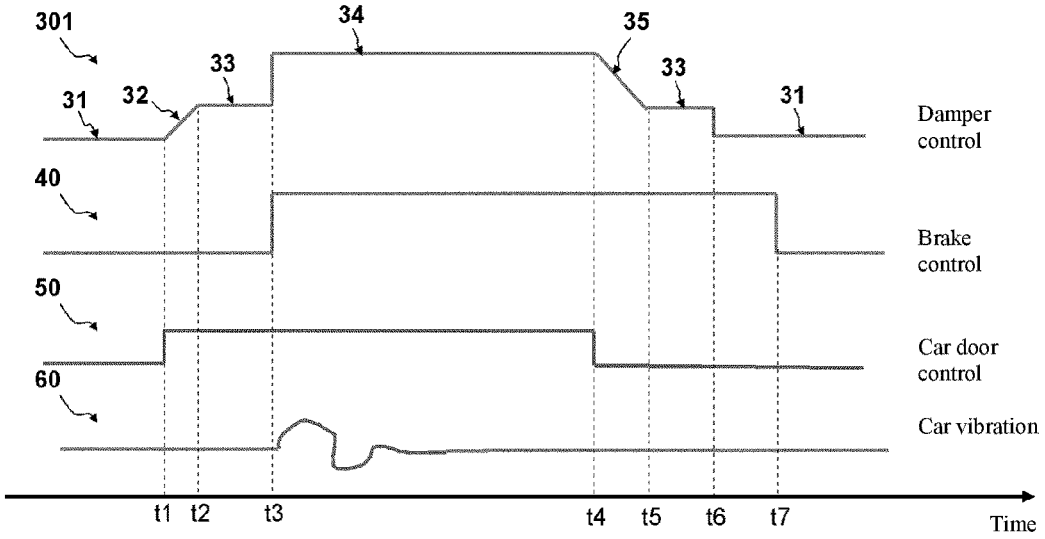
FIG. 13 is a schematic diagram of a principle of a control method of a damper according to a first embodiment of the present invention.

FIG. 13 is a schematic diagram of a principle of a control method of a damper according to a first embodiment of the present invention. In FIG. 13, a control method of the damper 100 is described with reference to brake control and car door control of the elevator system 10 and vibration of the elevator car 13. A control principle of the damper 100 is shown with a sequence diagram.

In the embodiment shown in FIG. 13, the elevator car 13, for example, works in an Advanced Door Open (ADO) mode. A temporal curve 301 represents a friction $F_{friction}$ output by the damper 100 working according to the control method in the embodiment of the present invention. In the case where a friction coefficient between the friction plate 171 and the guide surface 110 of the guide rail 11 is constant, the vertical axis direction thereof also represents a pressure applied by the clamp arm component 170*a* or 170*b* of the damper 100 on the guide surface 110. It would be understood that the pressure is output synchronously with the friction $F_{friction}$. A temporal curve 40 represents a sequence diagram of brake control working in the ADO mode, i.e., a brake control signal. The brake control acts on a dragging machine (which is not shown in FIG. 1). The dragging machine is a driver for driving the steel belt 13 during operation of the elevator system 10, where a period from t3 to t7 is a Brake On stage, and the dragging machine is braked in this stage, so that the dragging machine stops and the elevator car 13 stops movement (excluding movement corresponding to the vibration of the elevator car 13 mentioned in the present invention). Periods except t3 to t7 are Brake Off stages, and in these times, braking of the dragging machine is stopped, and the elevator car 13 would be driven to perform passenger carrying motion. A temporal curve 50 represents a sequence diagram of control over the car door (which is not shown in FIG. 1) working in the ADO mode, i.e., a car door control signal. In this embodiment, control over the car door is synchronous with control over a floor door. The time point t1 is a time point when the car door is triggered to open. It can be seen that the time point t1 is earlier than the time point t3. When the elevator car 13 is about to stop, the car door is driven to open in advance, that is, the car door works in the ADO mode. A temporal curve 60 represents a vibration situation of the elevator car 13, i.e., corresponding to an elevator car vibration signal. The temporal curve 60 may express magnitude and direction of vibration by using an acceleration characteristic value of the elevator car 13, and the vibration is vertical vibration in the direction of the guide rail 11 and may be generated because passengers get on or get off the elevator car 13.

In the control method in an embodiment, the elevator car 13 may be enabled to correspondingly work in at least three states, that is, the disengaged state 31, the damping output state 34, and a third state between the disengaged state 31 and the damping output state 34, i.e., a slight contact state 33. In the present application, the disengaged state 31 refers to a state in which the damper and the guide rail are kept free with respect to each other and the damper does not interfere with the guide rail. Generally, during normal passenger carrying motion of the elevator car 13, it is necessary to maintain the damper 100 in the disengaged state. The damping output state 34 means that the damper acts on the guide rail and generates a friction $F_{friction}$ for preventing the elevator car from moving. The magnitude of the friction $F_{friction}$ may be constant or may change dynamically. The slight contact state 33 means that the damper contacts the guide rail but basically does not generate any pressure on the guide rail or generates a pressure on the guide rail but hardly affects normal operation of the elevator car. In this state, the pressure generated on the guide rail is relatively small or is nearly 0 as compared with the pressure generated on the guide rail in the damping output state. Therefore, the friction output in the slight contact state 33 is nearly 0 or the output friction hardly affects normal operation of the elevator car. For example, the output friction hardly affects the tension degree or tensile status of the steel belt 14. The "normal operation" means that in a passenger carrying process, the elevator car moves according to a predetermined direction and speed under the driving of the dragging machine.

Referring to FIG. 13 continuously, in the control method in an embodiment, at the moment t1 when the car door of the elevator car 13 is triggered to open (a car door opening instruction is sent out at this moment), the solenoid drive part 120 of the damper 100 is powered on or electrified at the same time (for example, a solenoid is powered on and excited), thereby entering the slight contact state 33. It should be understood that, to transit from the disengaged state 31 at the time point t1 to the slight contact state 33 at the time point t2, the damper 100 needs a certain physical response time, and a period from t1 to t2 corresponds to the physical response time, i.e., time required for state transition, which is correspondingly a first transition process 32. Specific duration (t1-t2) required for the first transition process 32 is not limited, so long as the damper 100 can at least enter the slight contact state 33 before a time point t3.

Figure 17:
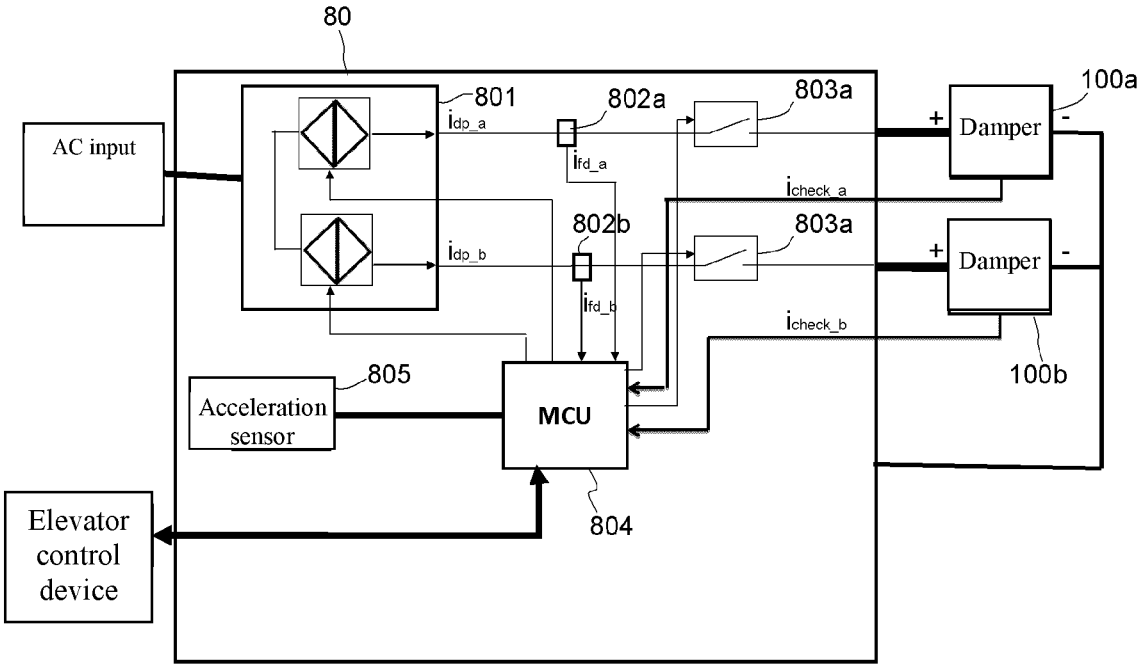
FIG. 17 is a schematic structural diagram of a controller of a damper according to an embodiment of the present invention.
Figure 18:
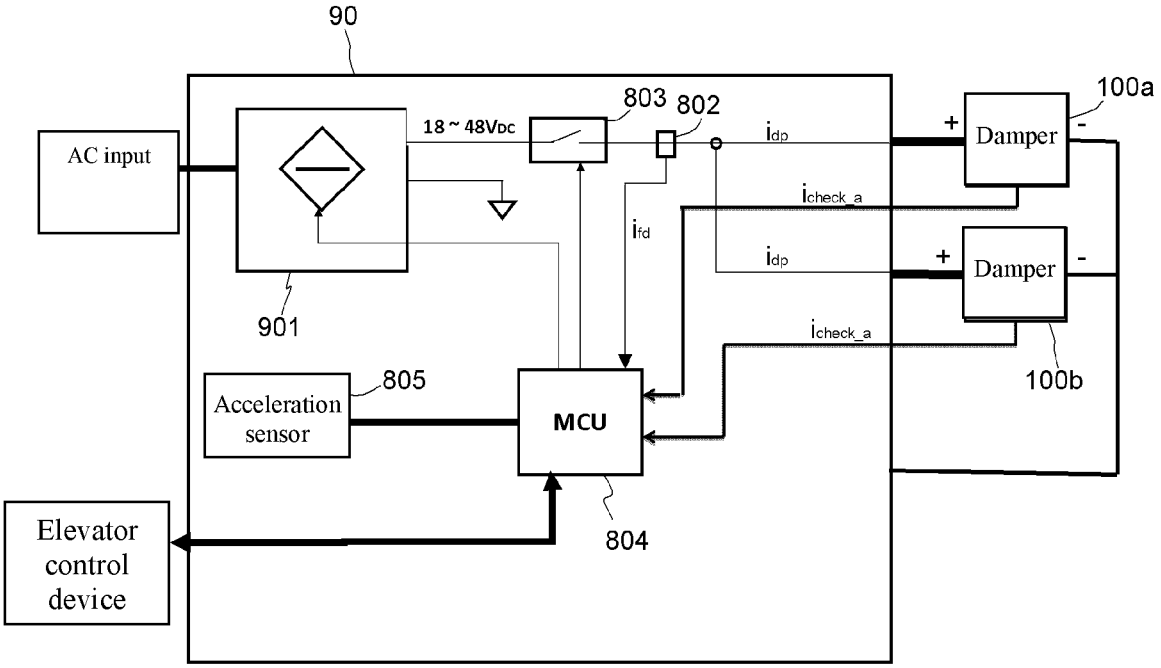
FIG. 18 is a schematic structural diagram of a controller of a damper according to another embodiment of the present invention.

It should be noted that a working principle of the damper 100 in the first transition process 32 is specifically as shown in FIG. 11. The solenoid drive part 120 is powered on, and the output shaft 121 thereof outputs a force $F_{solenoid}$ of certain magnitude. For example, by controlling magnitude of a current output to the solenoid drive part 120 using a controller 80 or 90 (as shown in FIG. 17 or FIG. 18), the magnitude of $F_{solenoid}$ can be controlled. Specifically, $F_{solenoid}=F_{reset\ sping}+F_{friction}$, where $F_{reset\ sping}$ is a tensile force generated by the two second restoration parts 182 when the friction plate 171 contacts the guide surface 110 of the guide rail 11, and Fiction is a friction generated by each damper 100 in the slight contact state 33. Definitely, the weights of the guiding part 140 and the link transmission component (the push rod 130 and the connecting rod 150) are not considered here. Therefore, by controlling the magnitude of the current of the solenoid drive part 120, the force $F_{solenoid}$ is controlled, and the magnitude of a relatively small friction $F_{friction}$ output by the damper in the slight contact state 33 can be controlled. For example, Fiction may be almost equal to 0. In the first transition process 32, the force $F_{solenoid}$ pushes the guiding part 140 to move upward, and while overcoming the tensile force $F_{reset\ sping}$ of the second restoration part 182, can drive the left clamp arm component 170*a* and right clamp arm component 170*b* to move synchronously towards the guide surface 110 of the guide rail 11, till the distance D=0, which indicates that the friction plate 171 contacts the guide surface 110 and the magnitude of the force $F_{solenoid}$ is not increased any more.

In the foregoing slight contact state 33, because the pressure on the guide rail 11 is relatively small or nearly 0, impact on the guide surface 110 is also very small during contact with the guide surface 110, and generated noise is greatly reduced, that is, noise generated at the time point t2 is small. Meanwhile, in the ADO mode, as braking is not completed before the time point t3, in this case, the elevator car 13 actually can still run for a relatively short distance at a relatively low speed, that is, the elevator car 13 has not completely stopped yet. The slight contact state 33 is maintained before the time point t3, and the friction $F_{friction}$ generated by the damper 100 is small enough, which thus neither affects motion of the elevator car 13 nor affects the tension degree of the steel belt 11 still in motion. When the damper 100 subsequently unclamps the guide rail 11, no vibration due to release of the friction $F_{friction}$ would be generated, and the accuracy of a weighing result of a weighing operation of the elevator car 13 at that moment would be hardly affected.

Referring to FIG. 13 continuously, at the time point t3, the car door has already been opened or is being opened, while the brake is triggered on to stop the elevator car 13 from moving, the damper 100 is enabled to enter the damping output state 34. In the process of switching from the slight contact state 33 to the damping output state 34, as the friction plate 171 is already in contact with the guide surface 110, by increasing the force $F_{solenoid}$ to a predetermined value, the damper 100 can be enabled to completely clamp the guide surface 110 and generate a friction $F_{friction}$ of predetermined magnitude. Therefore, a fast response speed is achieved. Upon stopping at the landing, the elevator car 13 immediately enters the damping output state 34, so as to keep the elevator car 13 stable with respect to the landing and alleviate the vibration of the elevator car 13. Similarly, based on the relational expression $F_{solenoid}=F_{reset\ sping}+F_{friction}$, the magnitude of $F_{friction}$ of the damping output state 34 can be controlled by controlling the magnitude of the current of the solenoid drive part 120. In an embodiment, the $F_{friction}$ is maintained at a constant value. For example, the friction $F_{friction}$ output by each damper 100 is basically equal to 350 N.

Referring to FIG. 13 continuously, at a time point t4, the car door of the elevator car 13 is triggered to close, and the car door starts to perform a door closing action. In this case, it can be basically determined that there is no passenger getting on or off the elevator car 13, and the weight of the elevator car 13 basically does not change. Therefore, at this time point, the damper 100 is controlled to start a second transition process 35, that is, a transition process in which the damper 100 is enabled to transit from the damping output state 34 to the slight contact state 33. This transition process is performed gradually. As shown in FIG. 13, in this embodiment, the magnitude of the current of the solenoid drive part 120 is controlled, so that the pressure applied by the damper 100 on the guide surface 110 is decreased linearly and the output friction $F_{friction}$ is also released linearly. For example, the friction is linearly decreased from 350 N to approximately 0. With such relatively slow change control, the friction released by the damper 100 does not act on the steel belt 14 instantaneously. Therefore, the elevator car 13 does not have obvious vibration, and passengers in the elevator car 13 have good experience.

In an embodiment, a period t4-t5 of the second transition process 35 is controlled within a range of 0.1 s to 1 s, so that the foregoing gradual transition can be fully implemented, and the friction released by the damper 100 may be released relatively slowly. The friction in the second transition process 35 is not limited to being linearly decreased. For example, the friction may also be stepped down.

Referring to FIG. 13 continuously, a time point t6 represents Door Fully Closed (DFC) at this moment. In this case, it can be completely determined that no passengers getting on or off the elevator car 13 (passengers are also not allowed to get on or off), and the weight of the elevator car 13 would not change at all. Therefore, the elevator car 13 would not vibrate. Therefore, at the time point t6, the magnitude of the current of the solenoid drive part 120 is controlled to be equal to 0, that is, the solenoid drive part 120 is powered off, and $F_{solenoid}=0$. Under the effect of the first restoration part 181 and the second restoration part 182, the damper 100 transits from the slight contact state 33 to the disengaged state 31, and the components in the damper 100 are also restored correspondingly. For example, in the disengaged state 31, the friction plate 171 may maintain a distance of about 6 mm to the guide surface 110, so as to ensure that the damper 100 in the disengaged state does not affect normal operation of the elevator car 100 on the guide rail 11.

In another alternative embodiment, if a distance from a current landing position to a next landing position at which the elevator car 13 needs to stop is less than or equal to a predetermined distance (for example, a distance between two landings), at the time point t6, the damper 100 may also be maintained in the slight contact state 33 (and does not transit to the disengaged state 31). In a stage in which the elevator car 13 runs from the current landing position to the next landing position where it needs to stop, the damper 100 is maintained in the slight contact state 33. Because the friction $F_{friction}$ is relatively small or is 0 in the slight contact state 33 and the elevator car runs for a relatively short distance (for example, runs between adjacent landing), the friction $F_{friction}$ basically would neither damage the guide rail (or the damage may be ignored) nor affect operation of the elevator car 13 in the current stage (or the influence may be ignored). However, it helps the damper 100 reduce the frequency of transiting from the slight contact state 33 to the disengaged state 31 and/or from the disengaged state 31 to the slight contact state 33 (the stage process from t1 to t2), thereby helping reduce the number of motions of components inside the damper 100 and improving the service life of the damper.

Referring to FIG. 13 continuously, at a time point t7, the car door has already been closed and the damper 100 enters the disengaged state 31, the brake of the dragging machine is turned off, and the elevator car 100 starts normal operation on the guide rail 11.

It should be noted that a period from t4 to t6 corresponds to a car door closing process, and this process may be relatively long. In practice, the following situations may occur: in the car door closing process from t4 to t6, a passenger in the elevator car 13 suddenly wants to leave and presses a button on the car door to open the car door again; a passenger getting on or off would cause the weight of the elevator car 13 to change, which may result in vibration of the elevator car 13. Therefore, in another alternative embodiment, if the controller of the damper 100 receives an instruction of opening the car door of the elevator car 13, an operation similar to that at the time point t3 will be performed, so that the damper 100 responds quickly and enters the damping output state 34 again, to prevent the elevator car 13 from vibrating. In this process, because the damper 100 is in the slight contact state 33, it is easy for the damper 100 to respond quickly and enter the damping output state 34.

It should be noted that, on the temporal curve 304 in the foregoing embodiment, a control process of the damper 100 corresponding to the stage t1-t3 (i.e., the process of controlling the damper to transit from the disengaged state 31 to the damping output state 34) and the control process of the damper 100 corresponding to the stage t4-t6 (i.e., the process of controlling the damper to transit from the damping output state 34 to the disengaged state 31) may be executed as a whole as shown in FIG. 13, or may be executed separately as discrete control methods. For example, only the process of controlling the damper 100 to transit from the disengaged state 31 to the damping output state 34 is executed, or only the process of controlling the damper 100 to transit from the damping output state 34 to the disengaged state 31 is executed. Moreover, the control processes have their corresponding technical effects respectively.

Figure 14:
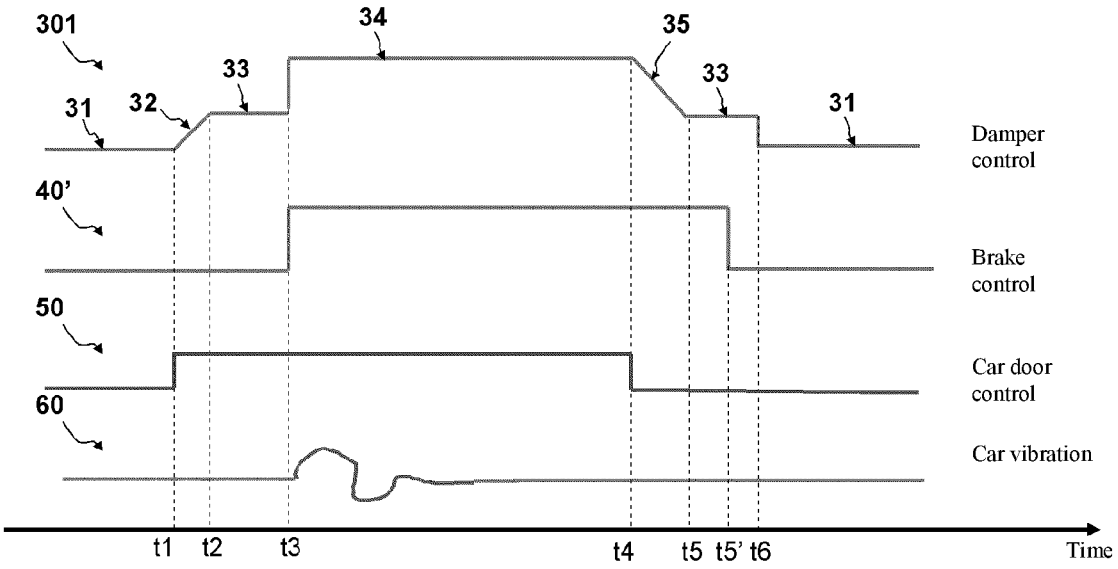
FIG. 14 is a schematic diagram of a principle of a control method of a damper according to a second embodiment of the present invention.

FIG. 14 is a schematic diagram of a principle of a control method of a damper according to a second embodiment of the present invention. Compared with the control method in the embodiment shown in FIG. 13, the main difference lies in that the elevator system 10 works in an Advanced Brake Lift (ABL) mode. When the brake is triggered off, i.e., corresponding to a time point t5', the damper 100 is in the slight contact state 33. It should be noted that, in the ABL mode, the brake is turned off before the car door is fully closed (corresponding to the time point t6). A temporal curve 40' represents a sequence diagram of brake control in the ABL mode, and the temporal curve 301 corresponding to the control method of the damper 100 basically remains unchanged.

Figure 15:
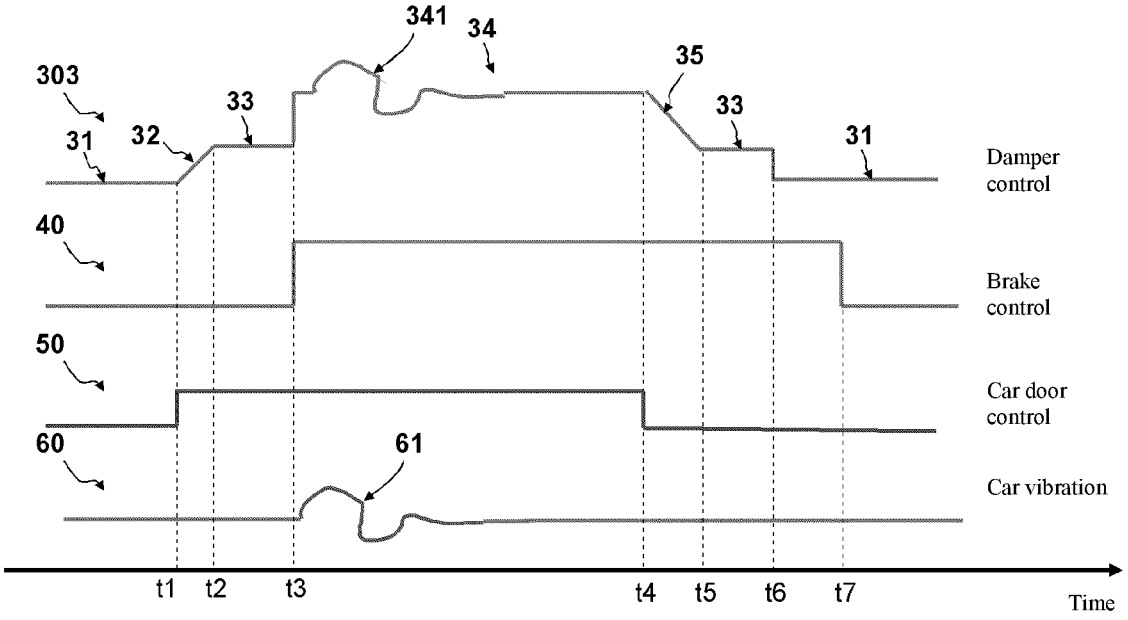
FIG. 15 is a schematic diagram of a principle of a control method of a damper according to a third embodiment of the present invention.

FIG. 15 is a schematic diagram of a principle of a control method of a damper according to a third embodiment of the present invention. The control method of the damper in the third embodiment corresponds to a temporal curve 303, and a main difference from the temporal curve 301 in the embodiment shown in FIG. 13 lies in that, in the damping output state 30 in the stage t3-t4, the output friction $F_{friction}$ is not kept constant. In the third embodiment, the friction $F_{friction}$ is dynamically controlled according to the vibration 61 of the elevator car 13. Therefore, the magnitude and direction of the friction $F_{friction}$ are also kept constant. Specifically, vibration of the elevator car 13 is indicated by 61 in the curve 60, and the vibration 61 may be represented by using an acceleration characteristic value. Therefore, the vibration 61 may be acquired in real time by an acceleration sensor or the like and provided to the controller of the damper 100. Based on the dynamic change of the vibration 61, the magnitude of the current applied on the solenoid drive part 120 may be synchronously adjusted dynamically, so that the friction output by the damper 100 may be increased as the vibration increases, and the friction output by the damper 100 may be reduced as the vibration decreases, thereby obtaining a curve 341 as shown in FIG. 15, i.e., a dynamic adjustment stage 341 corresponding to the friction of the damper 100. In this way, the damper 100 can reduce the vibration of the elevator car 13, thus achieving a better stabilization effect.

Figure 16:
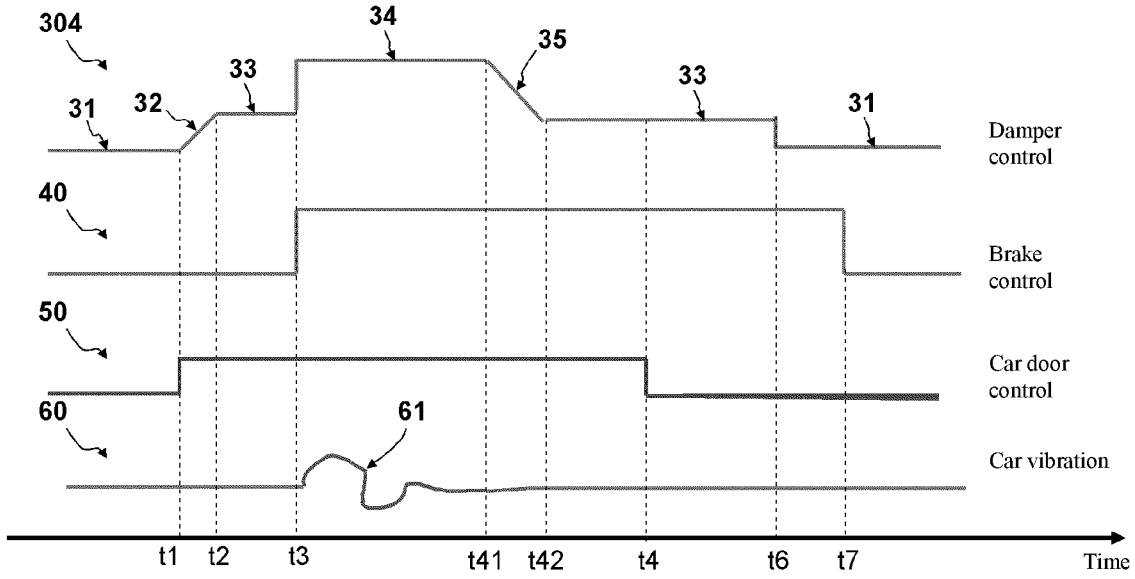
FIG. 16 is a schematic diagram of a principle of a control method of a damper according to a fourth embodiment of the present invention.

FIG. 16 is a schematic diagram of a principle of a control method of a damper according to a fourth embodiment of the present invention. The control method of the damper in the fourth embodiment corresponds to a temporal curve 304, and a main difference from the temporal curve 301 in the embodiment shown in FIG. 13 is a period from t41 to t6. In the fourth embodiment, in the case where the car door of the elevator car 13 is opened, factors such as passengers getting on or off may cause the elevator car 13 to generate vibration 61 in a curve 60. Similarly, the vibration 61 may also be acquired in real time by an acceleration sensor and provided to the controller of the damper 100. The controller monitors the magnitude of the vibration 61 and after the magnitude of the vibration has been less than or equal to a predetermined value for more than a predetermined time, the damper 100 is enabled to gradually transit from the damping output state 34 to the slight contact state 33 (that is, the car door is still open at this time). The magnitude of the vibration being less than or equal to the predetermined value indicates that the vibration is slight or is not large enough to be sensed by passengers, and the predetermined value thereof may be set according to a specific situation. For example, the predetermined value is equal to 10 mg. The predetermined time, for example, may be selected from 1 second to 5 seconds, indicating that vibration may not happen again. The judgment of "longer than a predetermined time" helps avoid excessively frequent switching between the damping output state 34 and the slight contact state 33. It should be noted that the transition process 35 in a period from t41 to t42 is substantially the same as the second transition process 35 in the embodiment shown in FIG. 13, and is not described in detail again here.

It should be noted that, in another embodiment, in a period from t42 to t6, i.e., in a stage in which the car door is still open or is not fully closed, considering that vibration may still occur due to factors such as passengers getting on or off and the sensor may still detect similar vibration, after the magnitude of the vibration is greater than the predetermined value (such as 10 mg), the damper 100 is enabled to transit from the slight contact state 33 back to the damping output state 34; this transition process may also be implemented with a quick response.

It should be noted that, in another embodiment, in a period from t3 to t5 in the control method in the foregoing embodiment, if a leveling or releveling operation needs to be performed on the elevator car 13, the damper 100 may be controlled to transit from the damping output state 34 to the slight contact state 33 when a Leveling or Releveling operation command is triggered. In this way, during the leveling or releveling operation, the damper 100 basically would not generate a friction against the guide rail 11, thereby avoiding wear and tear of the friction plate 171 and the guide surface 110 and avoiding affecting accuracy of the leveling or releveling operation. When the leveling or releveling operation is ended, the damper 100 may be controlled to transit from the slight contact state 33 to the damping output state 34.

It should be further noted that the control methods in the foregoing embodiments are not isolated from each other, and they may be implemented in random combination, to form a new embodiment of a control method. For example, the control methods in the embodiments shown in FIG. 15 and FIG. 16 are simultaneously implemented in combination.

FIG. 17 is a schematic structural diagram of a controller of a damper according to an embodiment of the present invention, and FIG. 18 is a schematic structural diagram of a controller of a damper according to another embodiment of the present invention. The controller 80 or 90 may be disposed in the damper 100 or may be disposed independent of the damper 100, or may be integrally disposed with respect to an elevator control device of the elevator system 10. It is possible to dispose one controller 80 or 90 corresponding to one damper 100, and it is also possible to dispose one controller 80 or 90 corresponding to multiple dampers 100. A specific setting form of the controller 80 or 90 is not limited. The controller 80 or 90 is mainly used for controlling the force $F_{solenoid}$ output by the solenoid drive part 120 in the damper 100, thereby implementing the control method in any of the foregoing embodiments.

As shown in FIG. 17, an MCU 804 is disposed in the controller 80. The MCU 804 is a control center of the controller 80, and may acquire a car door control signal and a brake control signal, such as the temporal curve 40 or 40' and the temporal curve 50, from the elevator control device through a CAN bus or the like, so that the controller 80 can control the damper 100 based on these signals.

A variable current source 801 is disposed in the controller 80. In the case where an alternating current is input to the variable current source 801, the variable current source 801 converts the alternating current into direct currents of certain magnitude, such as $i_{dp_a}$ and $i_{dp_b}$, and $i_{dp_a}$ and $i_{dp_b}$ are respectively provided to a damper 100*a* and a damper 100*b* controlled by the controller 80, where $i_{dp_a}$ may equal to $i_{dp_b}$. The specific magnitude of the current output by the variable current source 801 may be controlled by using a command of the MCU 804.

Referring to FIG. 17 continuously, in the controller 80, a switch part 803*a* may be disposed on a circuit connecting the variable current source 801 and the damper 100*a*, and a switch part 803*b* may be disposed on a circuit connecting the variable current source 801 and the damper 100*b*. Besides, a current detection feedback part 802*a* may further be disposed on the circuit connecting the variable current source 801 and the damper 100*a*, so that magnitude of a current input to the damper 100*a* currently can be detected in real time. A current detection feedback part 802*b* may further be disposed on the circuit connecting the variable current source 801 and the damper 100*b*, so that magnitude of a current input to the damper 100*b* currently can be detected in real time. Current signals $i_{fd_a}$ and $i_{fd_b}$ detected by the current detection feedback parts 802*a* and 802*b* are input to the MCU 804 as feedbacks.

When the solenoid drive part 120 of the damper 100*a* or the damper 100*b* is excited by a current, the output shaft 121 may output a force $F_{solenoid}$ of corresponding magnitude. The magnitude of the force $F_{solenoid}$ directly corresponds to the magnitude of the input current. Therefore, by controlling the magnitude of the currents, $i_{dp_a}$ and $i_{dp_b}$, transition between any two of the disengaged state 31, the slight contact state 33 and the damping output state 34 in the control methods in the foregoing embodiments may be implemented under control, and the magnitude of the friction output by the damper 100*a* or 100*b* in the slight contact state 33 and the damping output state 34 can be controlled.

Referring to FIG. 17 continuously, corresponding to the foregoing control methods shown in FIG. 15 and FIG. 16, an acceleration sensor 805 may be disposed in the controller 80 to detect the vibration 61 generated by the elevator car 13. The acceleration sensor 805 inputs a detected vibration-related signal to the MCU 804. In another embodiment, the MCU 804 can further obtain a signal indicating whether each damper 100*a* or 100*b* is in the disengaged state, for example, obtain feedback signals $i_{check_a}$ and $i_{check_b}$ from the dampers 100*a* and 100*b* respectively. The signals $i_{check_a}$ and $i_{check_b}$ may be forwarded by the MCU 804 to the elevator control device, so that the elevator control device controls the dragging machine to drive the elevator car 13 to run on the guide rail 11 only when it is determined that the dampers 100*a* and 100*b* are in the disengaged state, avoiding that the elevator car 13 operates when the damper 100 clamps the guide rail. Definitely, the signals $i_{check_a}$ and $i_{check_b}$ may be used by the MCU 804 for controlling output of the variable current source 801. For example, in the case where it is determined that the dampers 100*a* and 100*b* need to be in the disengaged state but the signals $i_{check_a}$ and $i_{check_b}$ indicate that the dampers 100*a* and 100*b* have not yet entered the disengaged state successfully, the MCU 804 controls the current output by the variable current source 801 to be 0.

It should be noted that, based on the received current signals $i_{fd_a}$ and $i_{fd_b}$, the MCU 804 can adjust and control in real time the magnitude of the currents output by the variable current source 801, so that the process of the control method in the foregoing embodiment can be implemented. Moreover, this facilitates precise control over the magnitude of the current applied on the damper 100, and also facilitates precise control over the friction $F_{friction}$ output by the damper 100. Specifically, the process of the control method in the foregoing embodiment can be implemented by setting a corresponding program in the MCU 804, and can be specifically implemented by controlling the currents output by the variable current source 801.

Compared with the controller 80 in the embodiment shown in FIG. 17, the controller 90 in the embodiment shown in FIG. 18 also has an MCU 804, a switch part 803, a current detection feedback part 802, and an acceleration sensor 805, and the controllers 80 and 90 have basically similar working principles. The controller 90 mainly differs from the controller 80 in that, a variable voltage source 901 used in the controller 90 outputs a direct current voltage $V_{DC}$, which is 18 V to 48 V for example, and the voltage is input to the dampers 100*a* and 100*b* at the same time. The magnitude of the current provided to the dampers 100*a* and 100*b* can also be controlled by controlling the magnitude of the voltage output by the variable voltage source 901. Moreover, in the controller 90 in this embodiment, the dampers 100*a* and 100*b* are controlled by using the same voltage signal, that is, the dampers 100*a* and 100*b* can be controlled completely synchronously.

In another embodiment, changes in resistance of the solenoid drive parts 120 of the dampers 100*a* and 100*b* during working may also be detected by configuring the MCU 804, so as to monitor whether the solenoid drive part 120 of the damper 100*a* or 100*b* overheats. In the case of overheating, the MCU 804 enables the variable current source 801 or the variable voltage source 901 to stop the output, thus implementing overheating protection for the dampers 100*a* and 100*b* (such as the solenoid of the damper).

Specifically, by using the controller 90 shown in FIG. 18 as an example, a current $i_{dp}$ acquired by the MCU 804 corresponds to an input current of the damper 100, and an output voltage of the variable voltage source 901 corresponds to an input voltage of the damper 100. The MCU 804 performs real-time detection to acquire $i_{dp}$ and the output voltage of the variable voltage source 901, and can calculate equivalent resistance R2 of the solenoid drive part 120 of the damper 100 under the condition of a current temperature based on $i_{dp}$ and the output voltage of the variable voltage source 901. Resistance R1 of the solenoid drive part 120 of the damper 100 under the condition of a converted temperature T2 may be tested in advance, and the current temperature T1 of a winding of the solenoid drive part 120 of the damper 100 can be calculated based on the following relational expression (1):

$$R2=R1\times(K+T2)/(K+T1) \quad (1)$$

where T2 is the converted temperature, which may be, for example, 15° C., 75° C. or 115° C.; R1 is the resistance of the winding of the solenoid drive part 120 of the damper 100 under the condition of the converted temperature T2; R2 is the resistance calculated after test, i.e., correspondingly the resistance of the winding of the solenoid drive part 120 of the damper 100 under the condition of the current temperature T1; K is a temperature constant of resistance. It is known that if the winding is a copper wire or an aluminum wire, a temperature constant of resistance K corresponding to the copper wire is 235, and a temperature constant of resistance K corresponding to the aluminum wire is 225.

Therefore, the current temperature T1 can be calculated according to the foregoing relational expression (1), so that the MCU 804 of the controller 80 or 90 can control the variable current source 801 or the variable voltage source 901 when the current temperature T1 is greater than or equal to a predetermined temperature condition, so that the solenoid drive part 120 of the damper 100 stops working, thus achieving overheating protection.

Figure 19:
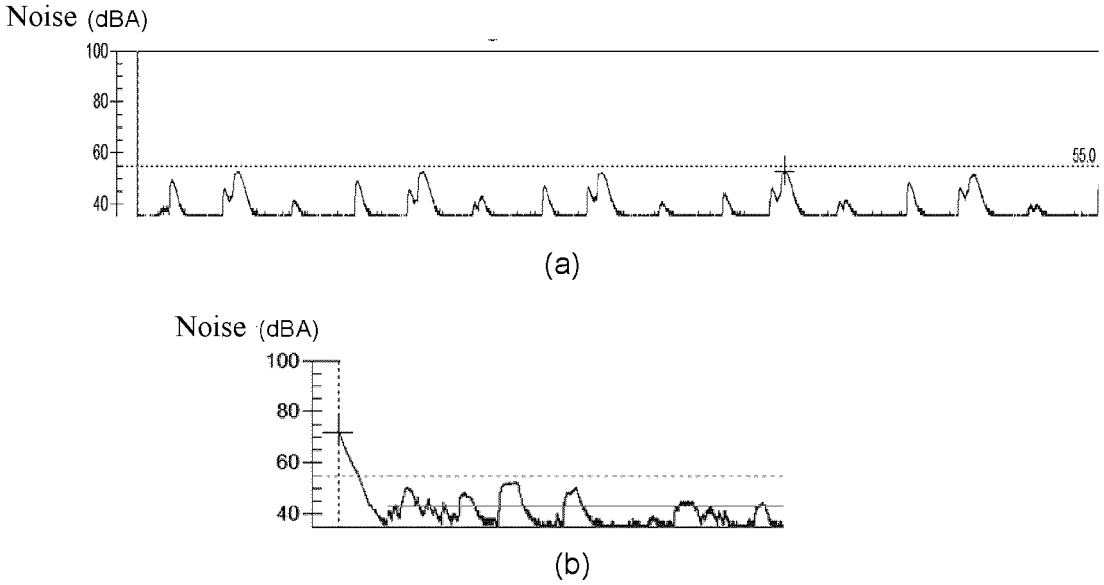
FIG. 19 is a schematic diagram of a noise test result when a damper according to an embodiment of the present invention works based on a control method according to an embodiment of the present invention, where FIG. 19(*a*) shows noise tested inside the elevator car, and FIG. 19(*b*) shows noise tested at the landing outside the elevator car.

FIG. 19 is a schematic diagram of a noise test result when a damper according to an embodiment of the present invention works based on a control method according to an embodiment of the present invention, where FIG. 19(*a*) shows noise tested inside the elevator car, and FIG. 19(*b*) shows noise tested at the landing outside the elevator car. It can be seen from FIG. 19(*a*) that, during the working process of the damper 100, the maximum noise tested inside the elevator car 13 is only 52.9 dBa, and it can be seen from FIG. 19(*b*) that, during the working process of the damper 100, the maximum noise tested at the landing is only 50.8 dBa. The noise is reduced relatively.

Figure 2:
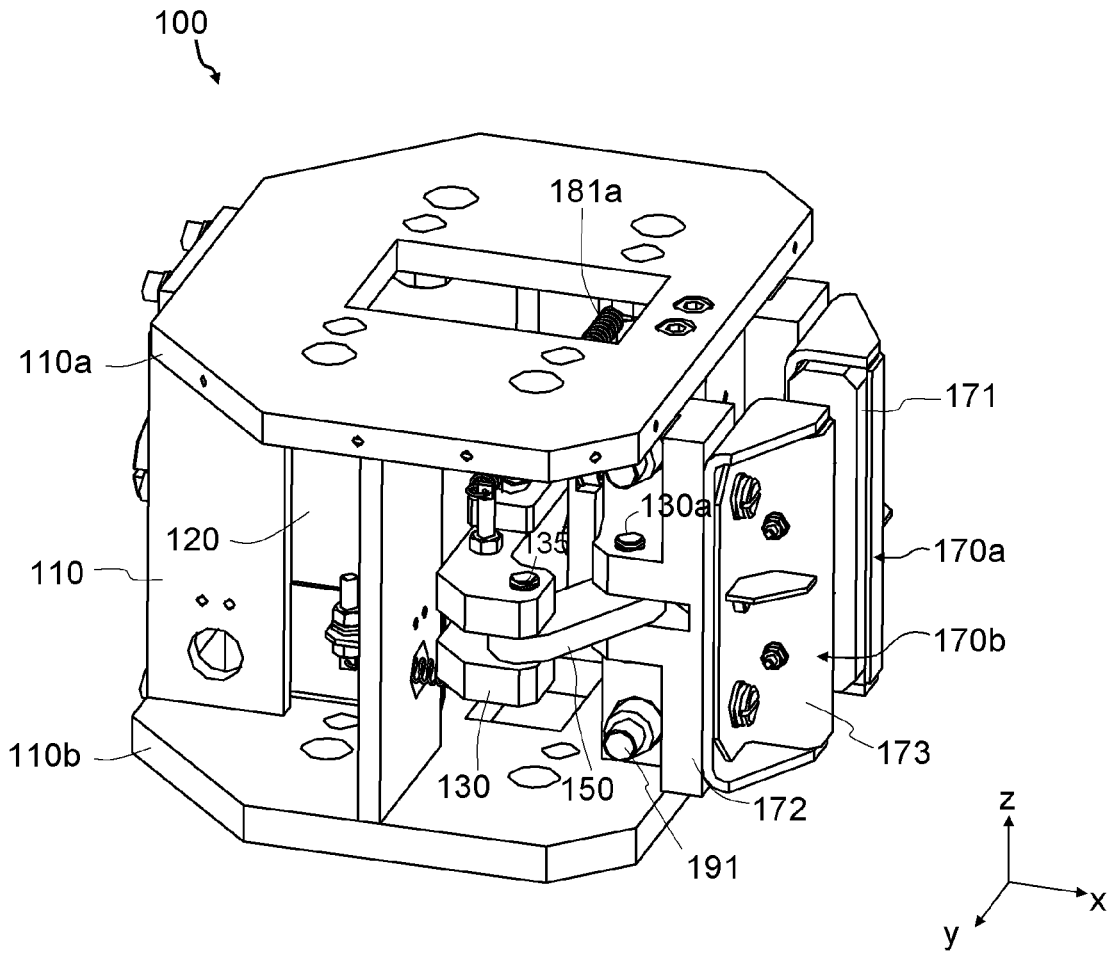
FIG. 2 is a three-dimensional schematic structural diagram of a damper of an elevator car according to an embodiment of the present invention.
Figure 3:
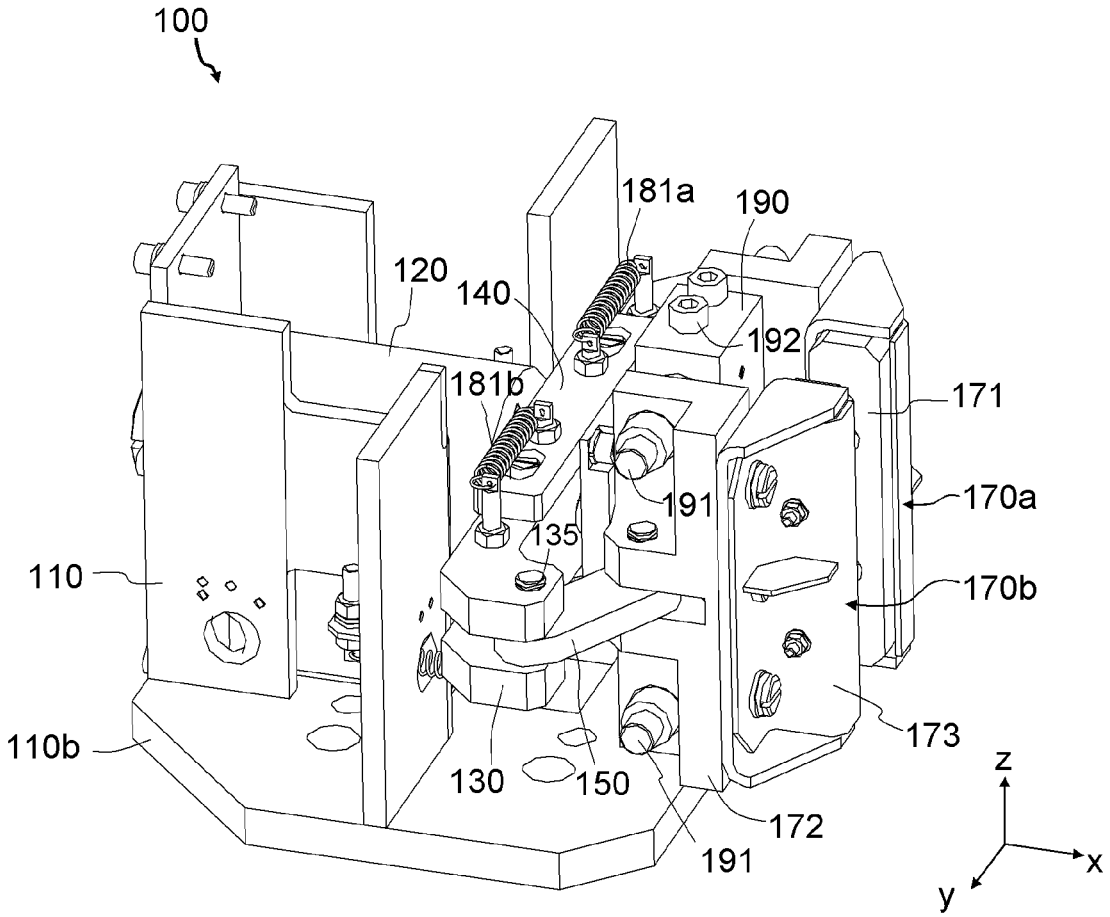
FIG. 3 is a three-dimensional schematic structural diagram of an internal structure of the damper in the embodiment shown in FIG. 2.
Figure 4:
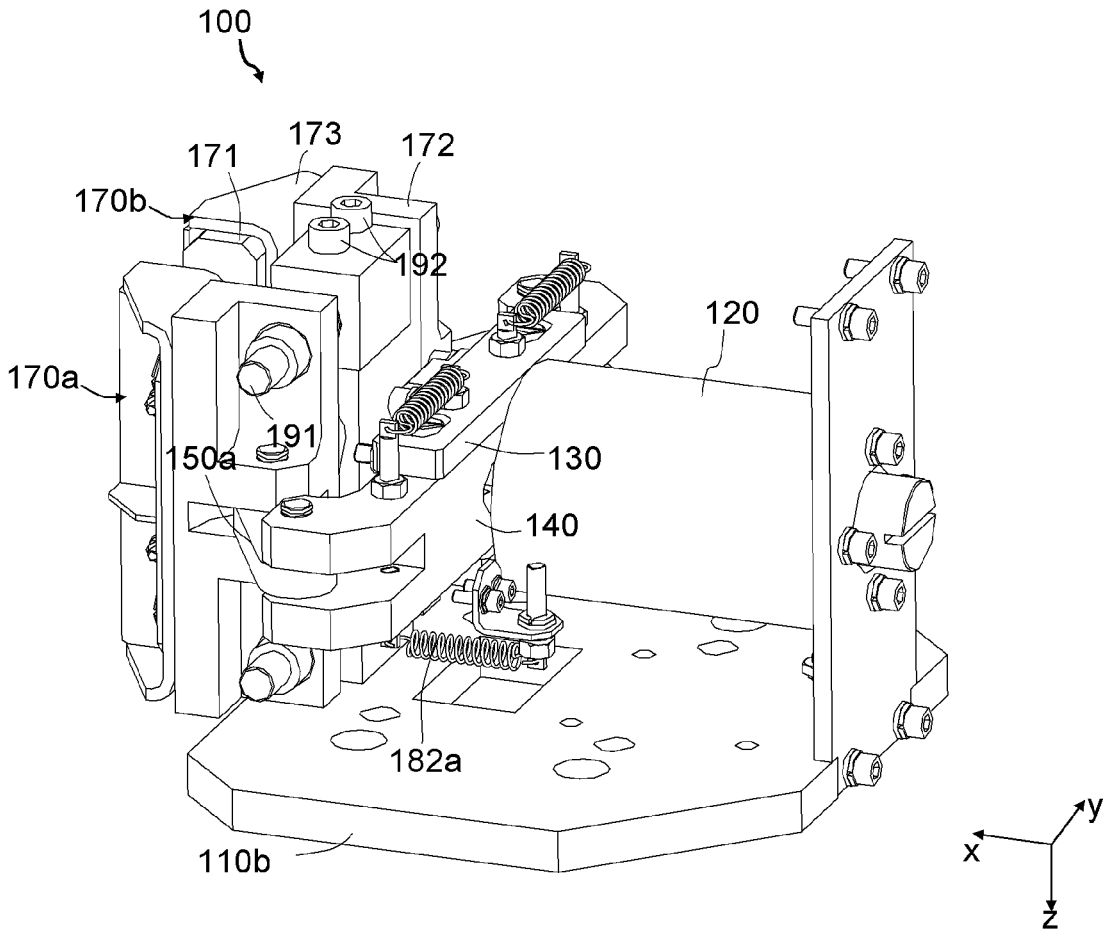
FIG. 4 is another three-dimensional schematic structural diagram of an internal structure of the damper in the embodiment shown in FIG. 2.
Figure 5:
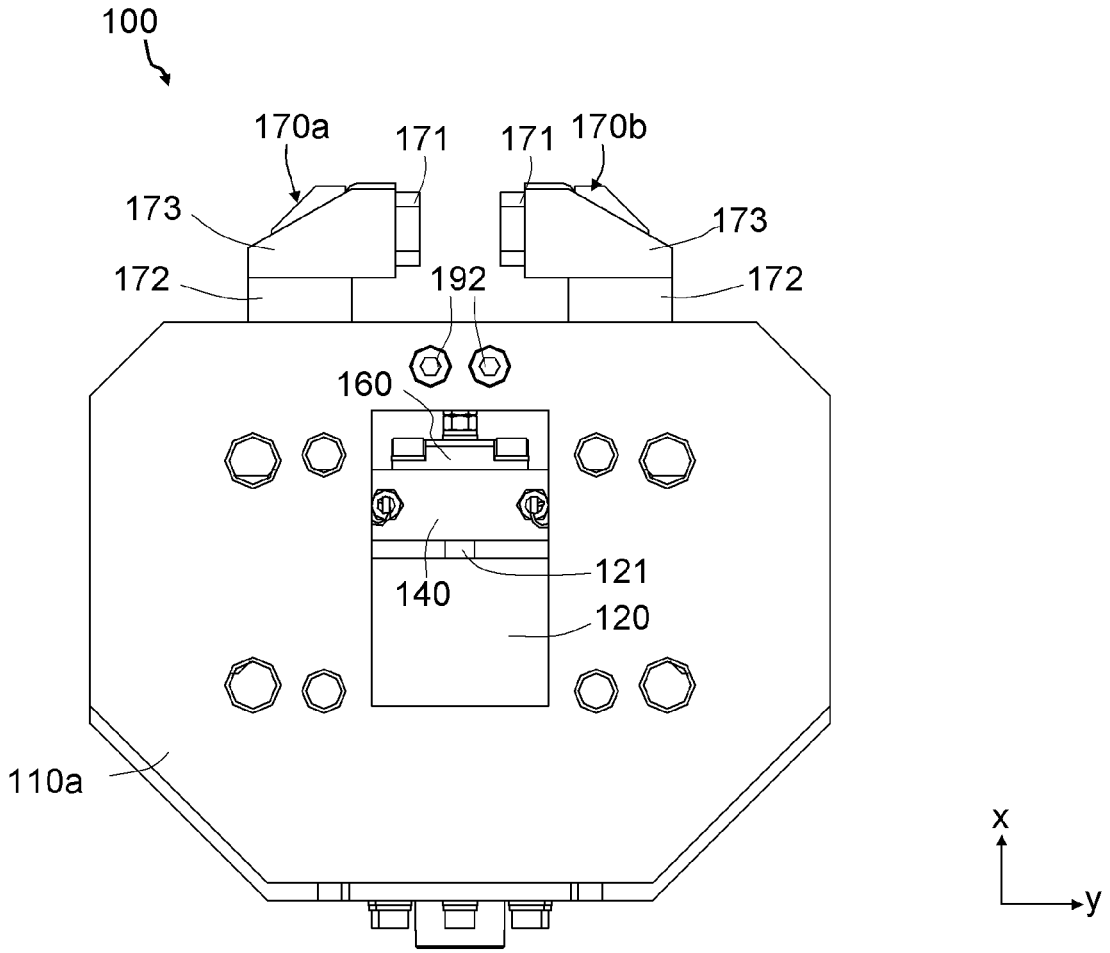
FIG. 5 is a top view of the damper in the embodiment shown in FIG. 2.

It should be noted that the control method and the controller of the damper in the foregoing embodiments are not limited to being applied to the damper 100 in the embodiment shown in FIG. 2. It would be understood that the control method and controller in the foregoing embodiments can be applied to any other types of dampers using a solenoid drive part (which can be controlled with an electrical signal) to provide a clamping force, such as the damper disposed in the Chinese Patent Application No. CN201080070852.8 entitled "Frictional Damper for Reducing Elevator Car Movement" (i.e., the damper disclosed in the U.S. Pat. No. 9,321,610B2), and can solve basically similar problems and achieve basically the same effects.

Figure 20:
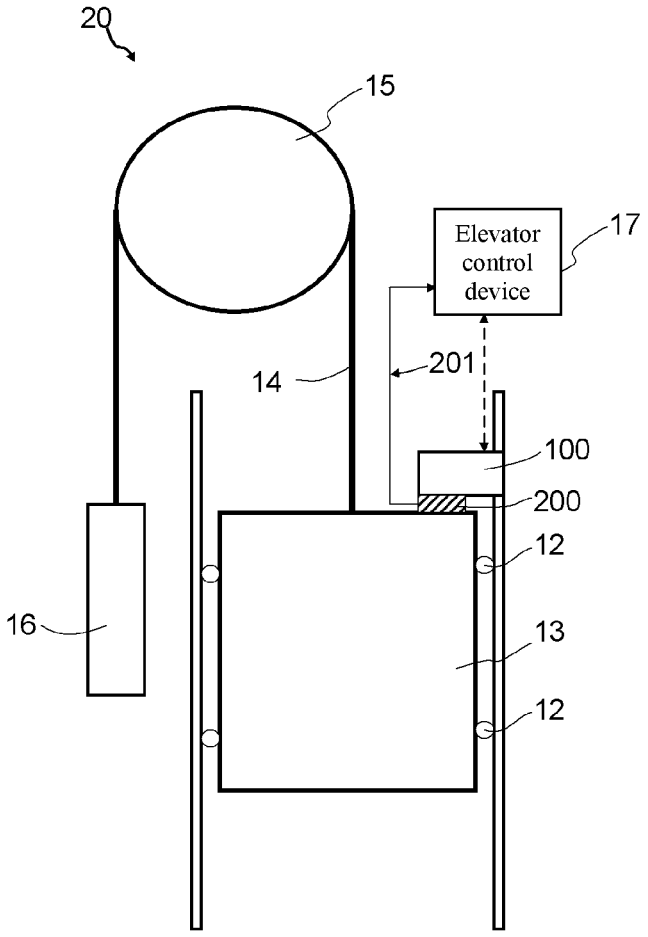
FIG. 20 is a schematic diagram of a basic structure of an elevator system according to another embodiment of the present invention.

FIG. 20 is a schematic diagram of a basic structure of an elevator system according to another embodiment of the present invention. In this embodiment, an elevator system 20 using the damper 100 in the embodiment shown in FIG. 2 is used as an example for description. The elevator system 20 is also provided with the elevator car 13 and the guide shoe 12 between the elevator car 13 and the guide rail 11, and further includes a dragging machine 150, a steel belt 14, a counterweight 16, and an elevator control device 17, where the elevator control device 17 controls operation of the entire elevator system 20, for example, controls braking, torque output and the like of the dragging machine 150. In the elevator system 20 in the embodiment of the present invention, a pressure sensor 200 for detecting a friction output by the damper 100 is disposed. During the working process of the damper 100, the friction $F_{friction}$ output by the damper 100 may be detected in real time by using the pressure sensor 200 to obtain a friction detection result signal 201. The pressure sensor 200 may be coupled with the elevator control device 17, and the friction detection result signal 201 is transmitted to the elevator control device 17. The elevator control device 17 may control operation of the elevator system 20 based on the friction detection result signal 201.

In the elevator system 20 in an embodiment and the control method thereof, the elevator control device 17 may be configured to calibrate a car weighing operation based on the friction detection result signal 201. The damper 100 outputs the friction $F_{friction}$, and the friction would cause a tension of the steel belt 14 tested by a weighing device disposed on the steel belt 14 of the elevator car 13 to be incorrect, thus resulting in an incorrect weighing result obtained by the elevator control device 17. Therefore, in this embodiment, in the elevator control device 17, the car weighing operation may be calibrated based on the tensile test result of the weighing device and the friction detection result signal 201. For example, if the friction $F_{friction}$ provided by the damper 100 to the elevator car 13 is an upward force along the guide rail 11, a calibrated weighing result is obtained after the friction $F_{friction}$ is added to the weighing result. If the friction $F_{friction}$ provided by the damper 100 to the elevator car 13 is a downward force along the guide rail 11, a calibrated weighing result is obtained after the friction $F_{friction}$ is subtracted from the weighing result.

The calibrated weighing result can reflect the current actual weight of the elevator car 13 more accurately. The calibrated weighing result may be used by the elevator control device 17 to perform other control operations.

In the elevator system 20 in another embodiment and the control method thereof, the elevator control device 17 may be configured to control the dragging machine 15 based on the friction detection result signal 201. It can be determined, according to the magnitude and direction of the friction $F_{friction}$ in the friction detection result signal 201, whether the release of the friction $F_{friction}$ causes the steel belt 14 to be further stretched or to be compressed (that is, judging impact of the release of the friction $F_{friction}$ on the tensile status or the tension of the steel belt 14). In a stage when the damper 100 unclamps the guide rail 11, if the damper 100 rapidly (rather than gradually) transits from the damping output state 34 to the slight contact state 33 or rapidly transits from the damping output state 34 to the disengaged state 31 directly, the friction $F_{friction}$ released instantaneously would cause the elevator car 13 to vibrate. In order to avoid the vibration, before or during the foregoing transition process, the elevator control device 17 controls, based on the friction detection result signal 201, the dragging machine 15 to output a pre-torque that is used to offset the impact on the steel belt due to the release of the friction $F_{friction}$, so as to avoid the vibration. For example, if the friction $F_{friction}$ provided by the damper 100 to the elevator car 13 is an upward force along the guide rail 11, the release of the friction $F_{friction}$ may cause the steel belt 14 to stretch; therefore, the elevator control device 17 may output a corresponding pre-torque to reduce the tension on the steel belt 14. Specific magnitude of the pre-torque is determined based on the magnitude of the friction $F_{friction}$.

Specifically, the pressure sensor 200 may be mounted between the damper 100 and the elevator car 13, and definitely, may also be mounted inside the damper 100, for example, between the cover plate 110*a* or 110*b* and the clamp arm component. A specific mounting position of the pressure sensor 200 is not limited, and may be mounted such that the friction $F_{friction}$ can be detected more accurately.

It should be noted that the control method of the elevator system 20 in the foregoing embodiment is not limited to being used in the elevator system of the damper in the example shown in FIG. 2, but may also be used in any other types of damper. The control method of the elevator system 20 in the foregoing embodiment is not necessarily used in a process in which passengers get on and off the elevator car at each floor, and may also be used in a process in which passengers get on and off the elevator car at some predetermined floors.

In the foregoing description, the "steel belt" is at least used for dragging a part of the elevator car, of which a width value in a first direction is greater than a thickness value in a second direction on a cross section perpendicular to the length direction, where the second direction is approximately perpendicular to the first direction. When used in an elevator system using a steel belt, the damper, the control method of the damper, and the controller corresponding to the damper in the foregoing embodiments of the present invention may have relatively apparent technical effects described above. However, it should be understood that the damper, the control method of the damper, and the controller corresponding to the damper in the foregoing embodiments of the present invention are not limited to being applied in the elevator system using the steel belt.

Various dampers of the present invention, the elevator system using the damper, and the control method of the damper are mainly illustrated above with examples. Although only some of implementations of the present invention are described, those of ordinary skill in the art should understand that the present invention can be implemented in many other forms without departing from the substance and scope of the present invention. Therefore, the shown examples and implementations are regarded as illustrative rather than limitative, and the present invention may cover various modifications and replacements without departing from the spirit and scope of the present invention as defined in the appended claims.

What is claimed is:

1. A damper of an elevator car, comprising:

a base fixedly mounted with respect to the elevator car;

a clamping mechanism used for clamping a guide surface of a guide rail to generate a friction (Ffriction) for preventing the elevator car from moving, the clamping mechanism mainly comprising two clamp arm components;

a solenoid drive part at least used for providing the clamp arm components with a force for clamping the guide surface of the guide rail, the force from the solenoid drive part applied to both the clamp arm components; and a link transmission component disposed between the solenoid drive part and the clamping mechanism, wherein the link transmission component is configured to be movable in a direction approximately perpendicular to the guide surface and drive at least one of the two clamp arm components connected thereto to move towards the guide rail.

2. The damper according to claim 1, wherein when the two clamp arm components clamp the guide rail, in the case where one of the two clamp arm components contacts the guide surface of the guide rail first and the solenoid drive part continues to output the force, the force is at least partially converted into a reactive force that is generated by the guide surface against the clamp arm component contacting the guide surface, and the reactive force pushes the link transmission component to move in the direction approximately perpendicular to the guide surface and drive the other of the two clamp arm components to move towards the guide rail.

3. The damper according to claim 1, wherein the clamp arm component comprises a friction plate capable of adaptively generating a maximum contact surface with the guide rail.

4. The damper according to claim 3, wherein the clamp arm component further comprises a clamp arm and a friction plate mounting base, and the clamp arm is mounted on a clamp arm mounting base on the base and is movable in the direction approximately perpendicular to the guide surface, the friction plate is detachably mounted on the friction plate mounting base, and the friction plate mounting base is mounted at a tail end of the clamp arm and is rotatable in a predetermined angle range with respect to the guide surface.

5. The damper according to claim 4, wherein the friction plate mounting base is provided with a first mounting hole and a second mounting hole, a first bolt and a second bolt for mounting the friction plate mounting base are disposed in the first mounting hole and the second mounting hole respectively, and the second mounting hole is shaped such that the friction plate mounting base is rotatable in the predetermined angle range with respect to the first mounting hole.

6. The damper according to claim 5, wherein the second mounting hole is elliptical.

7. The damper according to claim 4, wherein a guiding shaft in the direction approximately perpendicular to the guide surface is disposed on the clamp arm mounting base, and the clamp arm is mounted on the guiding shaft and be movable on the guiding shaft.

8. The damper according to claim 1, further comprising a guiding part that is substantially limited in the direction approximately perpendicular to the guide surface and is movable in a direction of the guide rail.

9. The damper according to claim 8, wherein the link transmission component comprises:

a push rod that is disposed on the guiding part and is movable with respect to the guiding part in the direction approximately perpendicular to the guide surface; and two connecting rods, wherein two ends of each connecting rod are rotatably connected to the push rod and the clamp arm component respectively; and the force (Fsolenoid) output by the solenoid drive part pushes the guiding part and the push rod to move along the direction of the guide rail, and the push rod and the connecting rod convert the force into a force pushing the clamp arm component to move towards the guide surface.

10. The damper according to claim 9, wherein the guiding part is provided with a guiding hole, the push rod is provided with a guiding protrusion, and the guiding protrusion is placed in the guiding hole and is guided to move in the guiding hole in a limited manner.

11. The damper according to claim 9, wherein first restoration parts are disposed between the guiding part and the push rod, and the first restoration parts are used for restoring the link transmission component and the clamp arm component.

12. The damper according to claim 9, wherein second restoration parts are disposed between the base and the push rod, and the second restoration parts are used for restoring at least the push rod and the guiding part in the direction of the guide rail.

13. The damper according to claim 9, wherein the push rod is provided with a via hole, and an output shaft of the solenoid drive part passes through the via hole to abut against the guiding part.

14. The damper according to claim 1, wherein the base comprises a first cover plate and a second cover plate that are disposed face to face in the direction of the guide rail and substantially parallel to each other.

15. The damper according to claim 14, wherein the damper is fixedly mounted between a car body of the elevator car and a guide shoe, wherein the damper is fixedly mounted on the elevator car by using the first cover plate/second cover plate, and the guide shoe is fixedly mounted on the second cover plate/first cover plate of the damper.

16. The damper according to claim 1, wherein the damper is installed with a sensor for detecting the friction (Ffriction).

17. The damper according to claim 1, further comprising a controller, wherein the controller is configured to enable the damper to work in a disengaged state, a slight contact state or a damping output state in which a friction (Ffriction) for preventing the elevator car from moving is generated;

and the controller is further configured to:

enable the damper to transit from the disengaged state to the slight contact state and then transit from the slight contact state to the damping output state.

18. A control method of a damper of claim 1, further comprising operating the damper in a disengaged state and a damping output state in which a friction (Ffriction) for preventing the elevator car from moving is generated, wherein in the control method, the damper is enabled to transit from the disengaged state to a slight contact state and then transit from the slight contact state to the damping output state.

19. A control method of a damper of claim 1, further comprising operating the damper in a disengaged state and a damping output state in which a friction (Ffriction) for preventing the elevator car from moving is generated, wherein, in the control method, the damper is enabled to gradually transit from the damping output state to a slight contact state.

* * * * *